US007624782B2

(12) United States Patent
Jungklaus et al.

(10) Patent No.: US 7,624,782 B2
(45) Date of Patent: Dec. 1, 2009

(54) TAPER TOOL

(75) Inventors: Matt Jungklaus, Lawrenceville, GA (US); David J. Castagnetta, Jr., Lawrenceville, GA (US)

(73) Assignee: Axia, Inc., Houston, TX (US)

( * ) Notice: Subject to any disclaimer, the term of this patent is extended or adjusted under 35 U.S.C. 154(b) by 775 days.

(21) Appl. No.: 11/213,049

(22) Filed: Aug. 26, 2005

(65) Prior Publication Data

US 2007/0044923 A1 Mar. 1, 2007

(51) Int. Cl.
*B32B 37/22* (2006.01)
*B44C 7/02* (2006.01)

(52) U.S. Cl. ..... 156/575; 156/576; 156/577

(58) Field of Classification Search ..... 156/71, 156/574, 575, 576, 577, 579
See application file for complete search history.

(56) References Cited

U.S. PATENT DOCUMENTS

| | | | |
|---|---|---|---|
| 2,502,499 | A | 4/1950 | Ames |
| 2,815,142 | A | 12/1957 | Ames |
| 3,116,195 | A | 12/1963 | Lathrop et al. |
| 3,260,638 | A | 7/1966 | Hoveland |
| 3,575,771 | A | 4/1971 | Padgett |
| 3,880,701 | A | 4/1975 | Moree |
| 3,890,191 | A | 6/1975 | Mayer |
| 3,960,643 | A | 6/1976 | Dargitz et al. |
| 4,003,781 | A | 1/1977 | Holsten |
| 4,080,240 | A | 3/1978 | Dysart |
| 4,086,121 | A | 4/1978 | Ames |
| 4,090,914 | A | 5/1978 | Hauk et al. |
| 4,116,748 | A | 9/1978 | Lass |
| 4,127,434 | A | 11/1978 | Lass |
| 4,196,028 | A | 4/1980 | Mills et al. |
| 4,358,337 | A | 11/1982 | Johnson et al. |
| 4,452,663 | A | 6/1984 | Heaton |
| 4,689,107 | A | 8/1987 | Entwistle |
| 4,828,647 | A | 5/1989 | Eccleston |
| 5,013,389 | A | 5/1991 | Retti |
| 5,279,700 | A | 1/1994 | Retti |
| 5,611,243 | A | 3/1997 | MacMillan |
| 6,294,034 | B1 | 9/2001 | O'Mara et al. |
| 6,513,562 | B1 | 2/2003 | Trout |
| 6,540,856 | B2 | 4/2003 | O'Mara et al. |
| 6,874,557 | B2 | 4/2005 | Jungklaus |
| 2004/0159406 | A1 * | 8/2004 | Jungklaus ..... 156/577 |

* cited by examiner

*Primary Examiner*—Mark A Osele
(74) *Attorney, Agent, or Firm*—Michael Best & Friedrich LLP

(57) ABSTRACT

A taper tool for applying tape to a wall surface is provided. The taper tool may simultaneously advance tape and apply mastic to the advancing tape. The taper tool may include a jam clearing assembly for clearing tape jams occurring along the tape path. The taper tool may include a body for holding mastic and a taper head coupled to an end of the body. The taper head includes a housing defining an opening and a mastic ejection nozzle, both of which are in fluid communication with the body. The opening facilitates introduction of mastic into the body and the nozzle facilitates ejection of the mastic from the body onto the tape. The taper head also includes a valve positioned within the opening to control introduction of mastic into the body, and a cover plate removeably connected to the housing to cover both the opening and the nozzle.

18 Claims, 21 Drawing Sheets

TAPER TOOL

FIELD OF THE INVENTION

This invention generally relates to taper tools and, more particularly, to taper tools that automatically and simultaneously advance tape and apply mastic to the tape.

BACKGROUND OF THE INVENTION

In the construction field, and particularly in interior construction, walls are commonly formed with a plurality of drywall sections or other materials used to construct interior walls. A wall joint is formed at a location where two wall sections meet. In order to provide a smooth, continuous wall appearance, tape must be applied to the wall joint. Tape is typically applied to wall joints with devices commonly referred to as taper tools.

Taper tools apply an adhesive to the tape and subsequently apply the adhesive and tape to a wall joint. Such adhesive is usually referred to as mud or mastic. A variety of taper tools exist in the market place, but the taper tools generally operate in a similar manner. Initially, the taper tool is used to apply the tape and mastic to a wall joint. The tape exits the tool from its first or forward end. After the taper tool reaches the top or bottom of the joint (depending on which direction the operator is applying the tape and mastic) and completes tape application for the particular wall joint, the operator activates a cutting mechanism used to cut the tape. Typically, the cutting mechanism is disposed on and behind the forward end of the taper tool. Accordingly, for the next application of tape to the wall surface, the tape must be advanced to the forward end of the taper tool. This can be performed by either manually grasping the tape and feeding the tape to the forward end or by a tape advancing assembly, which is also connected to the taper tool. The tape advancing assembly is actuatable by the operator and engages the tape to advance the leading edge of the tape toward the forward end of the taper tool. Unfortunately, advancing the leading edge of the tape in either of these manners does not provide tape with mastic applied thereto. Accordingly, the portion of the tape without mastic will not stick to the wall surface and will not provide an effective seal between wall sections.

The cutting mechanism can often create tape slivers when performing the cutting operation. Over time, the tape slivers can accumulate along the tape path and obstruct the advancement of tape along the tape path. If the tape advancement is sufficiently obstructed, a tape jam can occur in which the advancement of the tape along the tape path is halted altogether. In such a case, the operator must remove the tape from the tape guide, locate a thin component, such as a thin piece of metal, lying around the work place, insert the thin component into the tape path in an attempt to clear the jam manually, and re-insert the tape into the tape guide after the jam has been manually cleared. Location and insertion of components into the tape path can be time consuming in clearing the jam and such insertion can damage components of the taper tool.

After multiple operations of the taper tool or at the end of a work day, the taper tool may need to be cleaned. Several components of the taper tool require cleaning, but cleaning is often difficult. Such components include a filler tube and filler valve used to refill the taper tool with mastic and an ejection nozzle used to eject mastic from the taper tool onto the tape. In some taper tools, the ejection nozzle is defined by a bottom wall, side walls and a removeable cover plate closing the top of the nozzle. The cover plate is removeable to provide access to the nozzle. The filler tube and filler valve are located above the cover plate and in a front face of the taper tool. Commonly, the filler tube is not removeable by an operator, making cleaning of the filler tube and the filler valve located behind the filler tube difficult and time consuming.

BRIEF SUMMARY

In view of the foregoing, a taper tool is needed that is capable of simultaneously advancing tape and applying mastic to the advancing tape. Also, a taper tool is needed that quickly and effectively clears jams. In addition, a taper tool is needed that is easy and quickly cleanable.

In some aspects, a taper tool is provided that includes a body for holding a supply of mastic, a spool assembly for supporting a spool of tape, a drive roller positioned at an end of the taper tool, the tape being feedable from the spool of tape and at least partially around the drive roller to be applied to a wall surface, an actuator supported by and moveable along the body, a tape advancing assembly coupled to the actuator and engageable with the tape to advance the tape toward the drive roller, and a mastic application assembly coupled to the actuator and operable to apply mastic to the tape, wherein movement of the actuator advances the tape toward the drive roller and applies mastic to the advancing tape.

In some aspects, a taper tool for applying tape to a wall surface is provided. The taper tool includes a body, a taper head supported at an end of the body for applying the tape to a wall surface, wherein the tape feeds through the taper tool to the taper head along a tape path, and a jam clearing assembly supported by at least one of the body and the taper head and operable to clear a tape jam along the tape path.

In some aspects, a taper tool for applying tape to a wall surface is provided. The taper tool includes a body for holding a supply of mastic and a taper head coupled to an end of the body, the taper head including a housing defining a housing opening and a mastic ejection nozzle, both of which are in fluid communication with the body, the housing opening facilitating introduction of mastic into the body and the nozzle facilitating ejection of the mastic from the body onto the tape, a valve positioned within the housing opening, to selectively control introduction of mastic into the body, and a cover plate removeably connected to the housing to cover both the housing opening and the nozzle.

Figure 1:
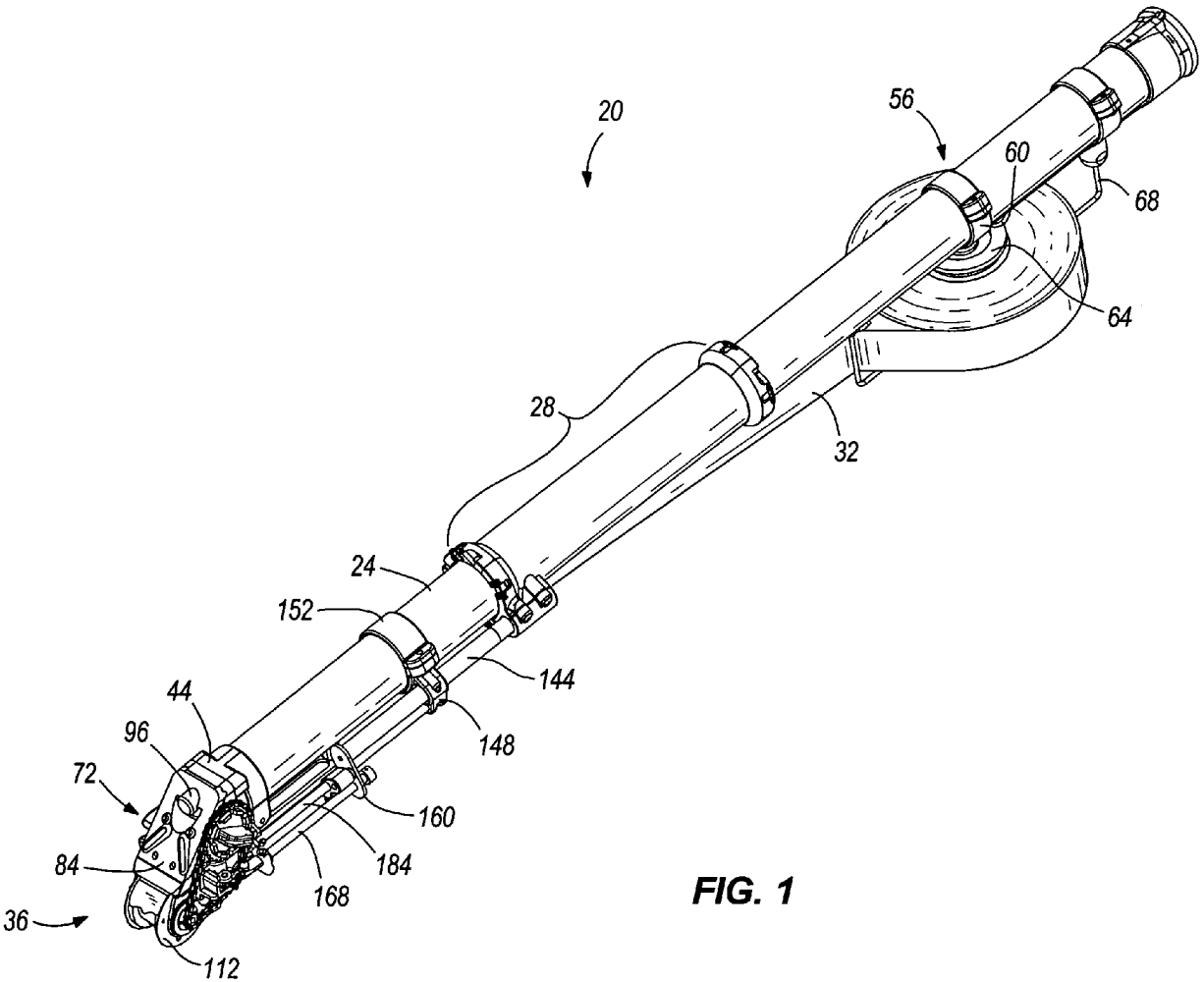
FIG. 1 is a top perspective view of a taper tool.

Before at least one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways.

DETAILED DESCRIPTION

Figure 2:
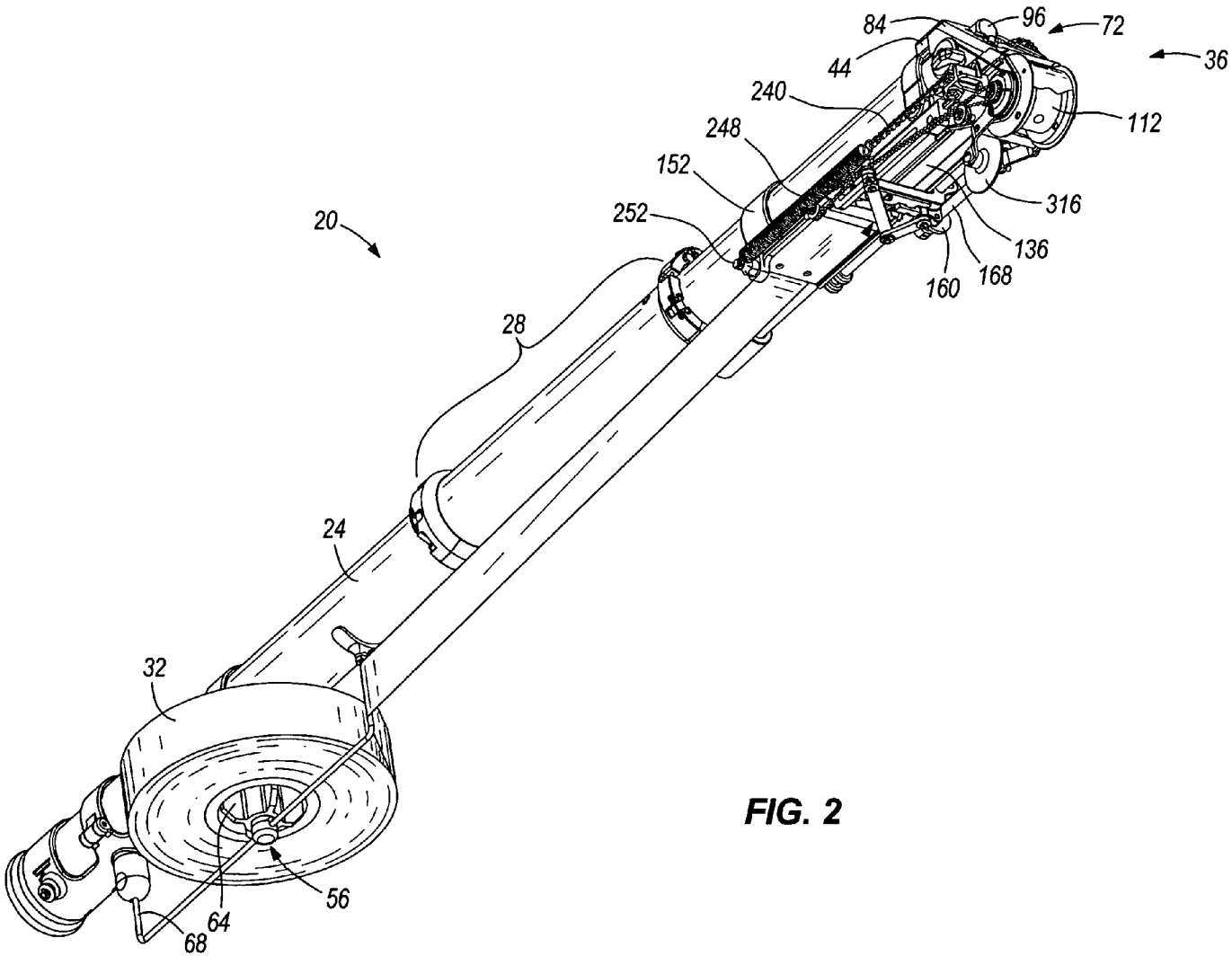
FIG. 2 is a bottom perspective view of the taper tool shown in FIG. 1.

Referring to FIGS. 1 and 2, a taper tool 20 is illustrated. The taper tool 20 has some common structure with the taper tools described in U.S. Pat. Nos. 4,086,121 and 6,874,557, the entire contents of both are hereby incorporated by reference. Some of the common structure between the taper tool 20 of the present invention and the taper tools described in such patents generally relates to feeding tape, delivering tape, creasing tape, cutting tape and the general design and operation of taper tools, except as otherwise described hereafter.

The taper tool 20 includes a body 24 generally having the shape of a hollow cylinder for holding a supply of an adhesive or a sealant, hereinafter referred to as "mastic". Mastic may be of natural or synthetic origin, and is also known as "plastic" or "mud". An actuator or sleeve 28 is slidably mounted on the body 24 for feeding tape 32 to a forward or first end 36 of the taper tool 20, applying mastic to the tape 32, and for actuating a cutting knife 40 to cut the tape 32, all of which will be discussed in greater detail below.

Figure 12:
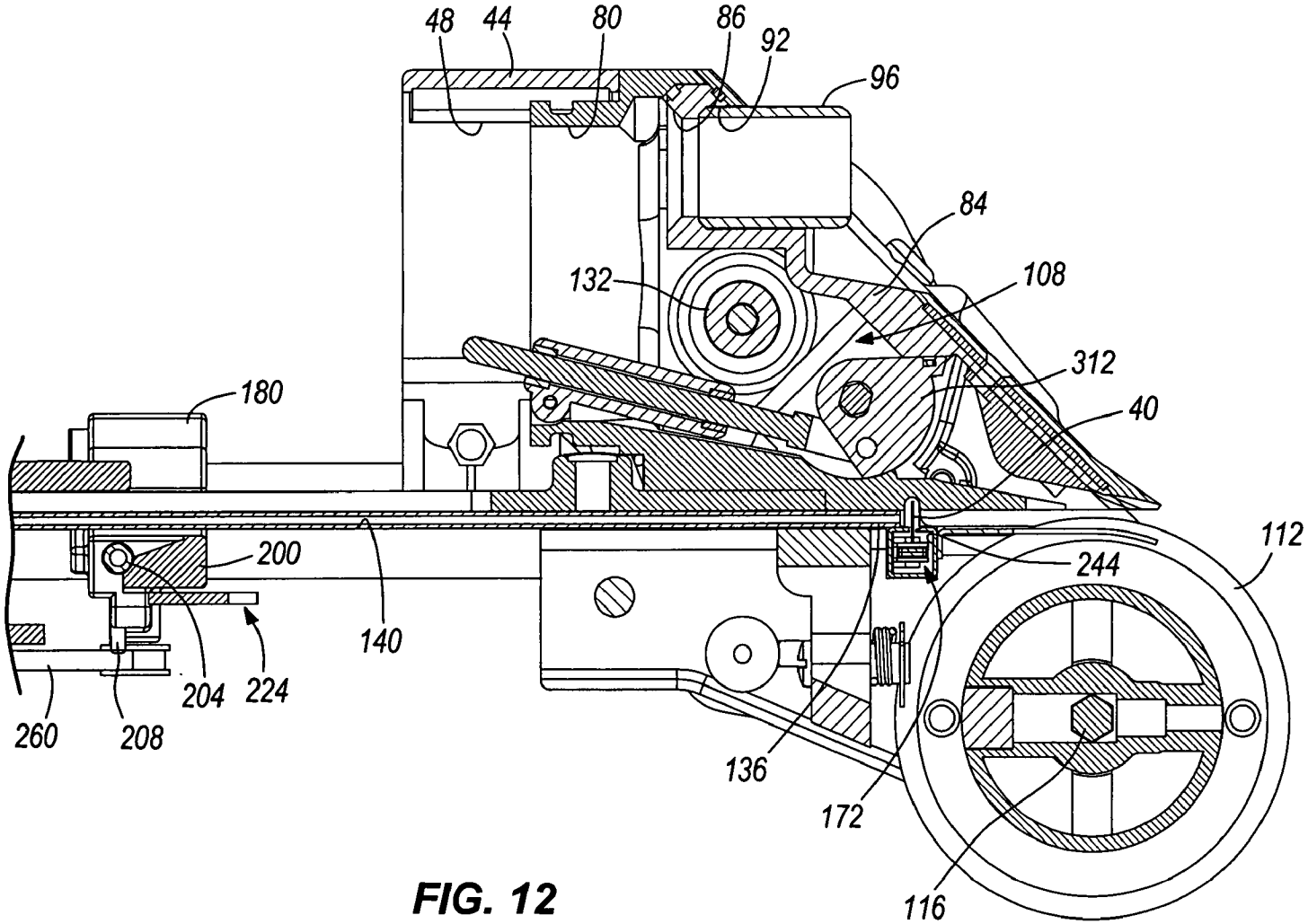
FIG. 12 is a cross-sectional view taken along line 12-12 in FIG. 11, shown with the tape guide advancing assembly in the retracted condition.
Figure 14:
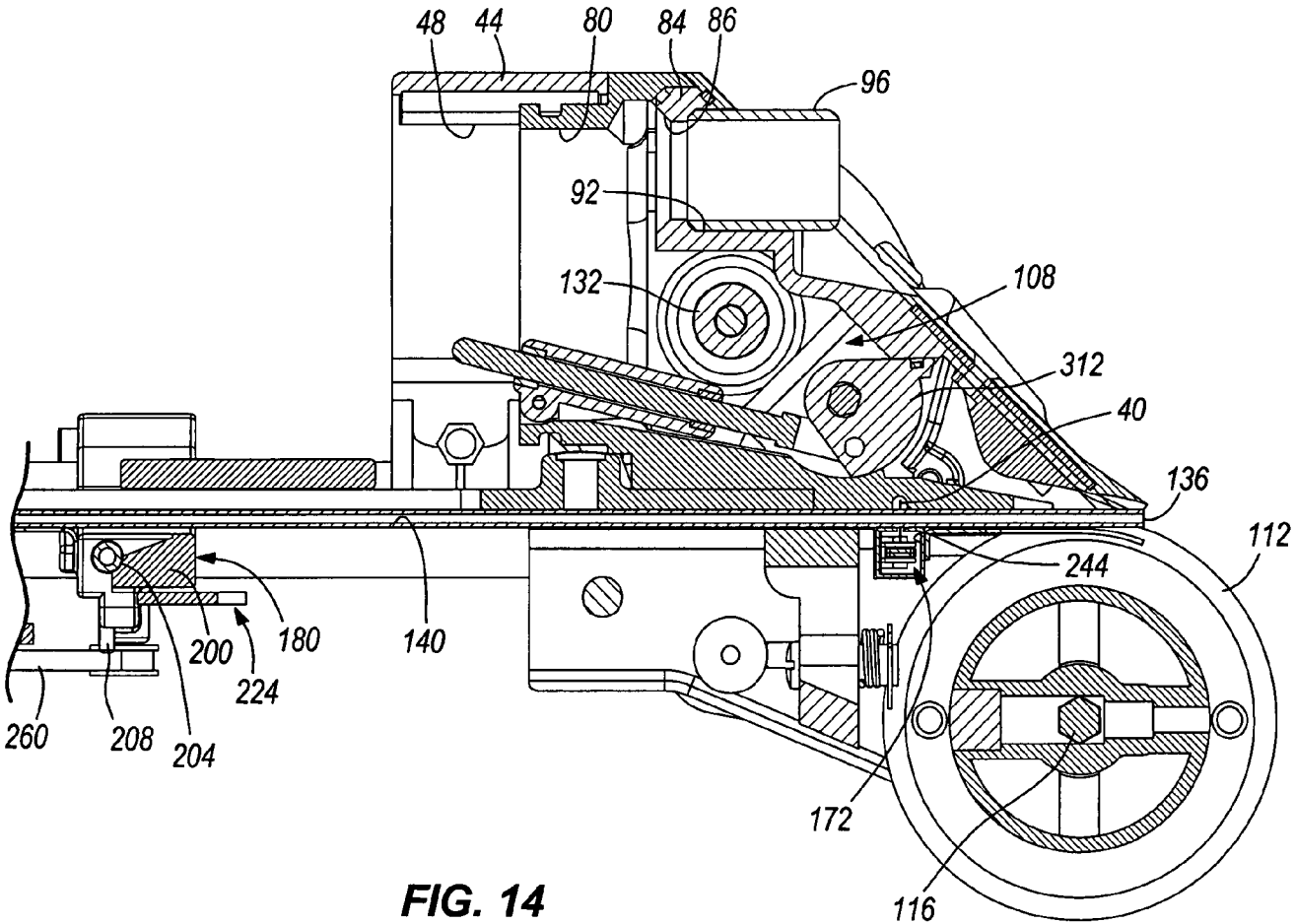
FIG. 14 is a cross-sectional view taken along line 14-14 in FIG. 13, shown with the tape guide advancing assembly in the advanced condition.

The forward end 36 of the body 24 includes a front cap 44, which defines an opening 48 (see FIGS. 12 and 14). A spring-biased filler valve 52 (see FIG. 9) is positioned in the opening 48 and interacts with a cover plate 84 (discussed below) to allow mastic to be introduced into the body 24, under pressure, for filling purposes (discussed in greater detail below). The cover plate includes a valve seat 86 (see FIGS. 12 and 14), in which the valve 52 is positionable and engageable with the cover plate 84 to seal the interior of the body 24 from the environment. This seal prevents mastic from escaping from the interior of the body 24 past the valve 52. The opening 48 also allows secretion of the mastic therethrough from the body to a nozzle 108 (discussed below) for application of the mastic onto tape 32.

With continued reference to FIGS. 1 and 2, a spool assembly 56 is connected to the body 24 for holding a spool of tape. The spool assembly 56 includes a base 60 for connecting the assembly to the body 24, a rotatable spool 64 for supporting the spool of tape, and a guard rod 68. For a more complete description of the spool assembly 56, reference is made to the disclosure of U.S. Pat. No. 6,874,557.

Figure 3:
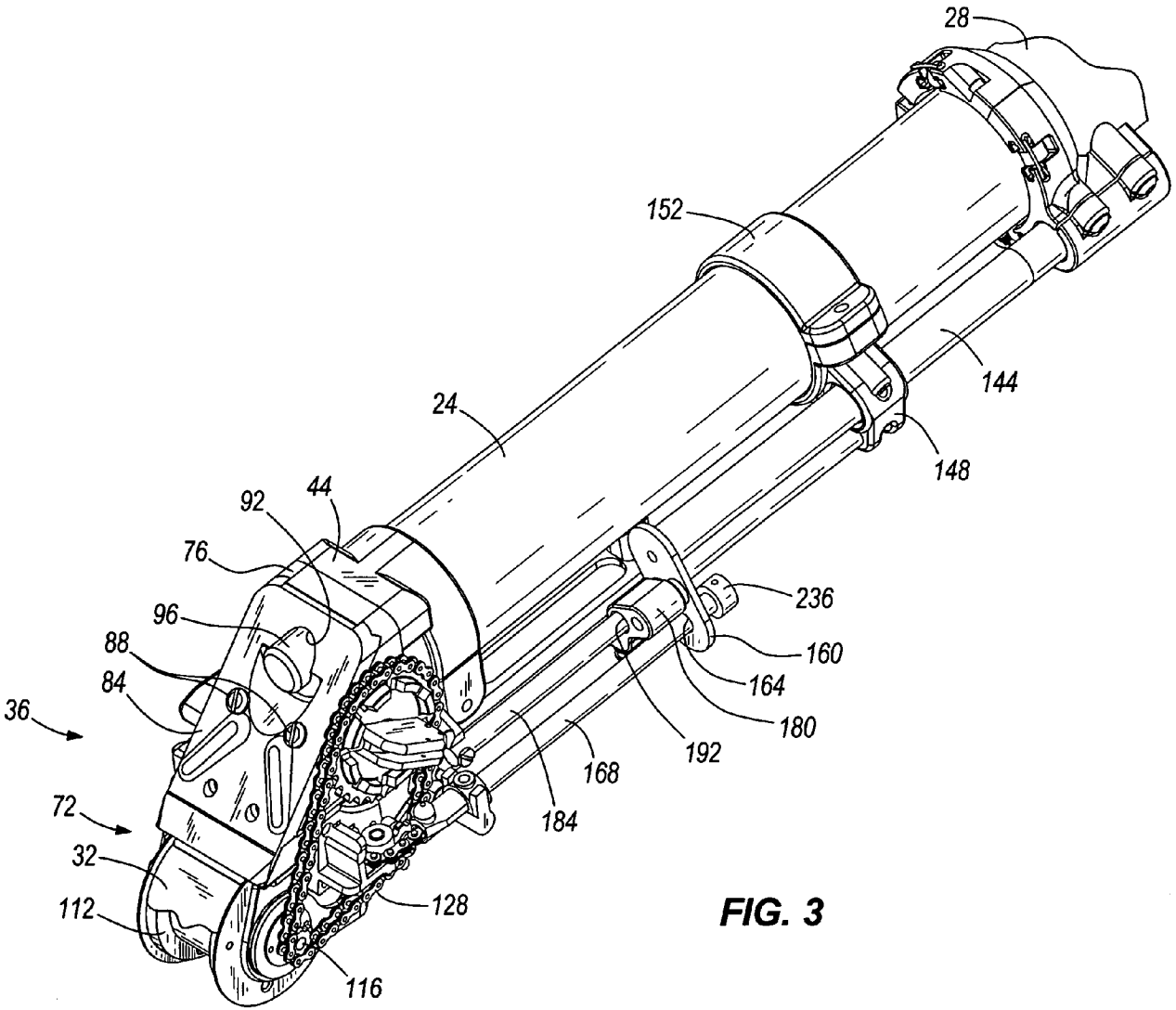
FIG. 3 is an enlarged top perspective view of a portion of the taper tool shown in FIG. 1.
Figure 4:
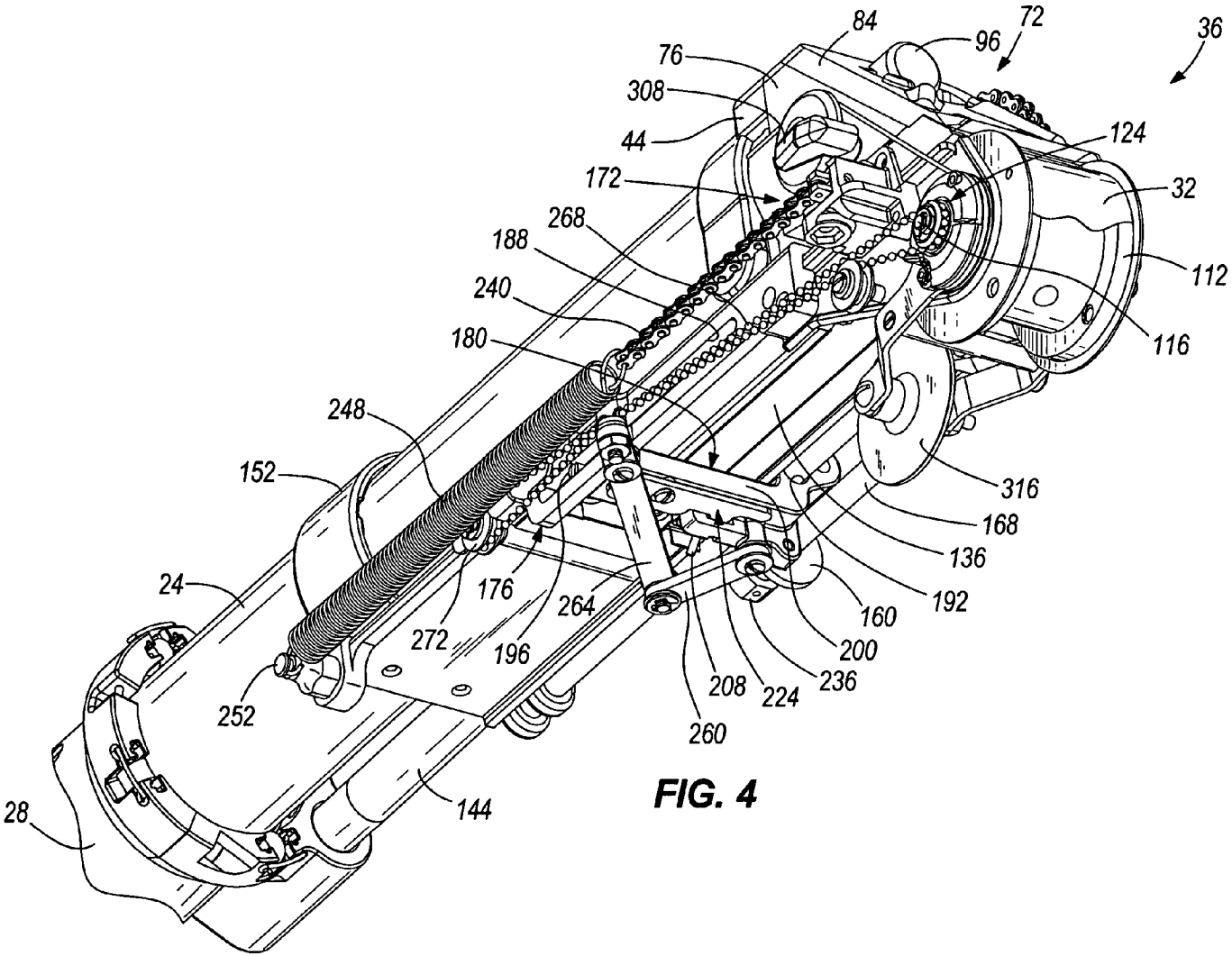
FIG. 4 is an enlarged bottom perspective view of a portion of the taper tool shown in FIG. 1.
Figure 9:
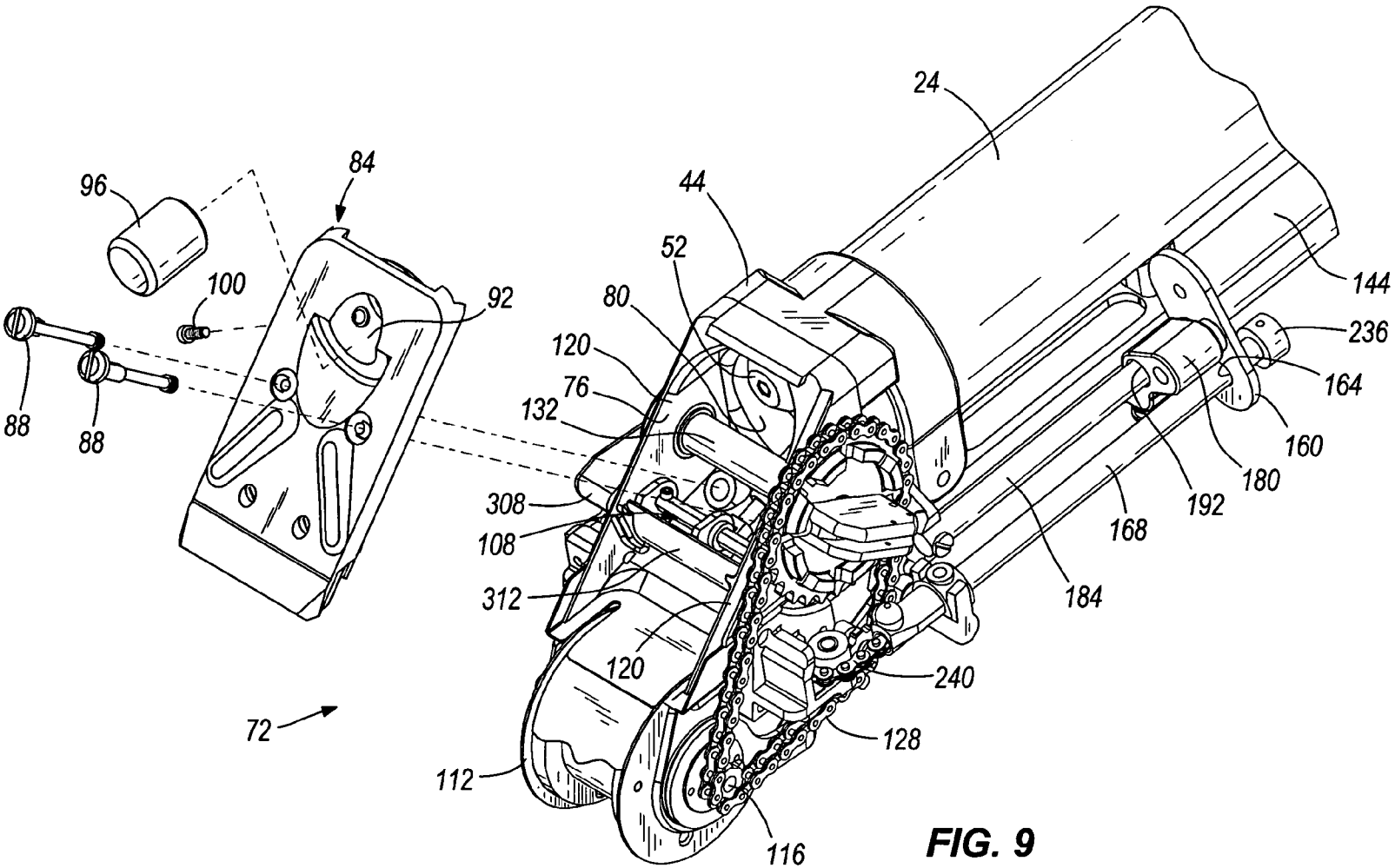
FIG. 9 is a partially exploded, top perspective view of a portion of the taper tool shown in FIG. 1.

Referring now to FIGS. 3, 4 and 9, the taper tool 20 includes a taper head 72 connected to a forward end 36 of the body 24. The taper head 72 includes a head housing 76 connectable to the front cap 44 of the body 24 and defining a head opening 80 in a rear of the head housing 76 in alignment with the opening 48 of the front cap 44 to allow secretion of mastic from the body 24, through the openings 48, 80 and into the head housing 76. A cover plate 84 is removably connectable to the head housing 76 via fasteners 88. The cover plate 84 defines a cover plate aperture 92 therein that is alignable with the filler valve 52 when the cover plate 84 is connected to the head housing 76. A filler tube 96 is removably connectable to the cover plate 84, via a fastener 100, in the cover plate aperture 92. When the cover plate 84 is connected to the head housing 76, the filler tube 96 aligns with the filler valve 52. To fill the body 24 with mastic, mastic is forced into the filler tube 96 under pressure, the mastic opens the filler valve 52 and the mastic enters the interior of the body 24. When the filling operation is complete, the filler valve 52 closes to prevent the mastic from escaping.

The removeable cover plate 84 and filler tube 96 enable easy cleaning thereof and easy cleaning of the head housing 76 and filler valve 52, which were not easily cleanable in previous taper tools. The filler tube 96 can be removed from the cover plate 84 for individual cleaning and the filler valve 52 is exposed upon removal of the cover plate 84 to facilitate cleaning thereof.

With continued reference to FIGS. 3, 4 and 9, mastic passes from the interior of the body 24, through the openings 48, 80 and into a mastic ejection nozzle 108 for applying mastic to the tape 32. The taper head 72 also includes a drive roller 112 that receives the tape 32 and holds it in sliding contact with an under surface of the nozzle 108 so that the upper surface of tape 32 receives a layer of mastic from the nozzle 108. The drive roller 112 applies tape 32 with the mastic facing toward the wall surface (not shown). The drive roller 112 is mounted on a shaft 116, which is carried by extended side walls 120 of the head housing 76. A unidirectional clutch 124 is coupled to the shaft 116 and will be described in greater detail below.

The drive roller 112 is coupled to a mastic application assembly, via a chain 128, that forces mastic from the interior of the body 24, through the openings 48, 80 and into the nozzle 108 where the mastic is applied to the tape 32. The mastic application assembly includes a piston (not shown) positioned in the body 24, a rotatable shaft 132 (see FIG. 9) connected between the side walls 120, and a cable (not shown) connected at one end to the shaft 132 and at the other end to the piston. Rolling the drive roller 112 along the wall causes the chain 128 to move, which rotates the shaft 132. The cable winds around the rotating shaft 132 and simultaneously pulls the piston toward a forward end 36 of the body 24, thereby forcing mastic out of the openings 48, 80 and into the nozzle 108.

With reference to FIGS. 1-8B, the tape advancing assembly, which is involved in advancing the tape 32, will be described. The tape advancing assembly advances the free end or leading end of the tape 32 from a position behind the drive roller 112 to a position near the drive roller 112. Advancing the free end is necessary after tape cutting (discussed below) or initial threading of tape 32 into the taper tool 20. The taper tool 20 includes a tape guide 136 coupled to the body 24 and defines a channel 140 (see FIGS. 8A,8B, 12, and 14) therethrough. Tape 32 is fed from the spool of tape, through the channel 140 in the tape guide 136, through the head housing 76 adjacent the nozzle 108, and over the drive roller 112. The tape guide 136 ensures proper alignment of the tape 32 with the nozzle 108 and facilitates proper tape feeding through the taper head 72. The path described above along which the tape 32 is fed is known as the tape path.

Figure 5:
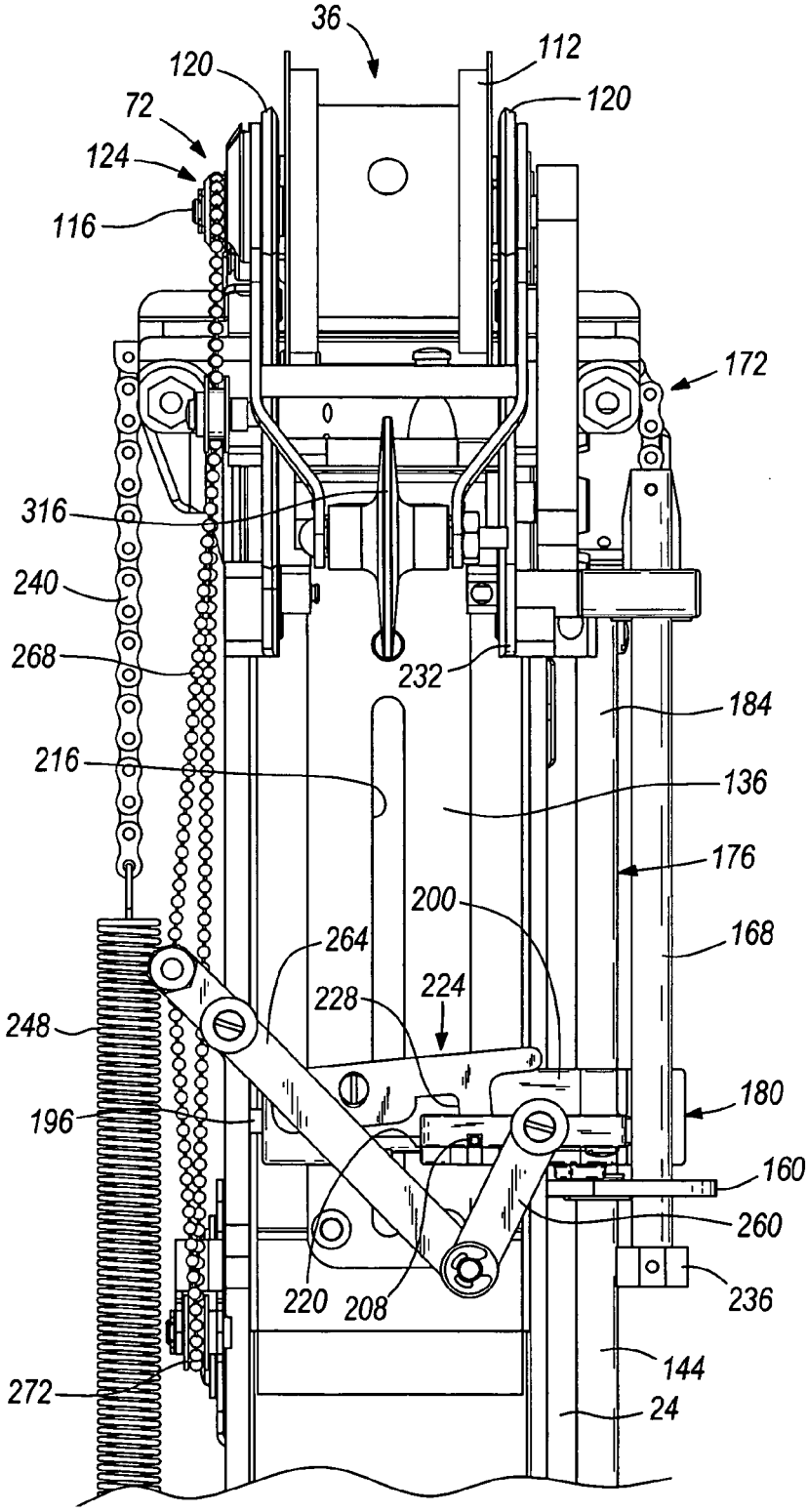
FIG. 5 is a bottom view of a portion of the taper tool shown in FIG. 1, shown with a tape advancing assembly in a retracted condition.
Figure 6:
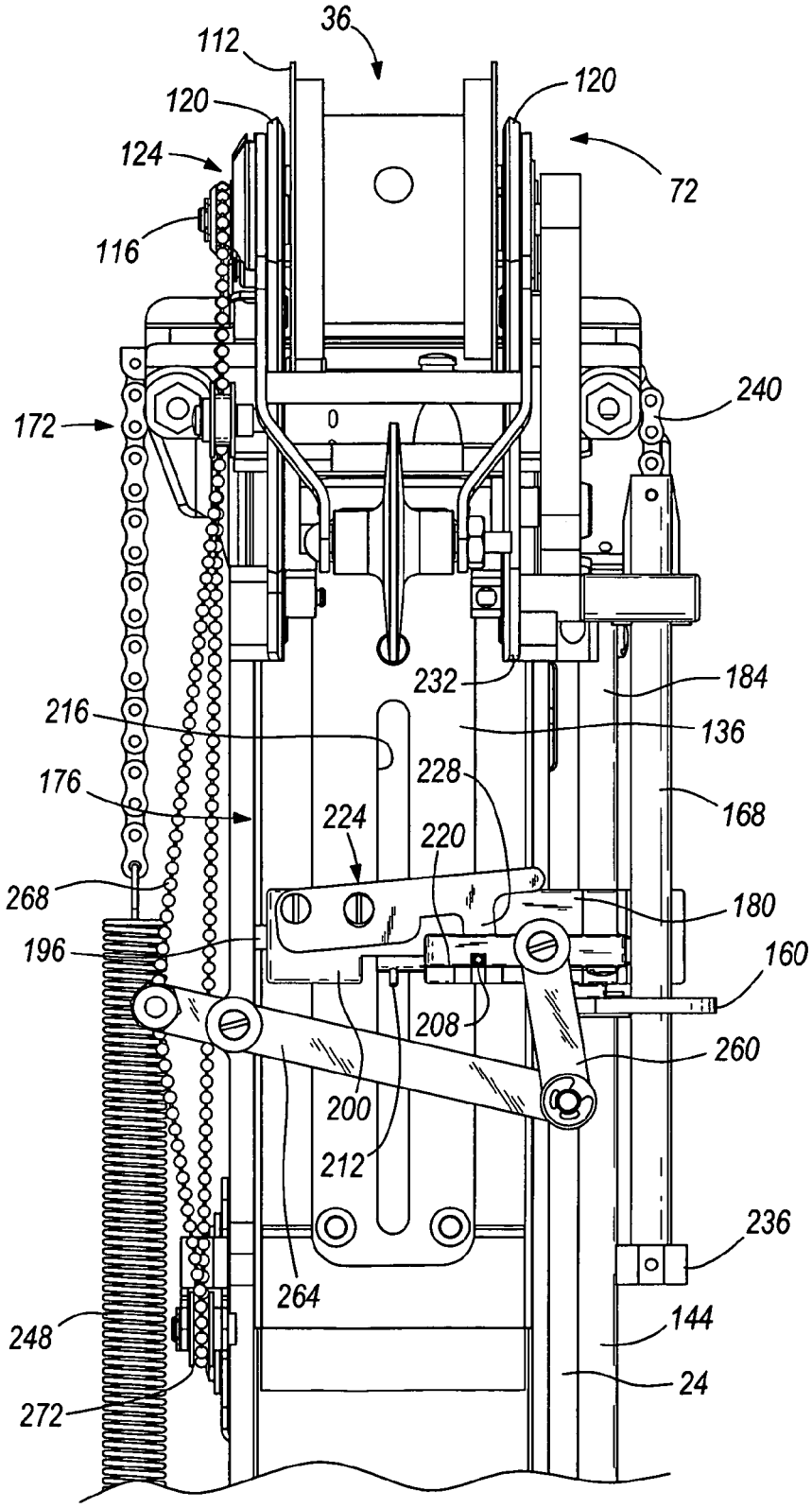
FIG. 6 is a bottom view of a portion of the taper tool shown in FIG. 1, shown with the tape advancing assembly in an intermediate condition.
Figure 7:
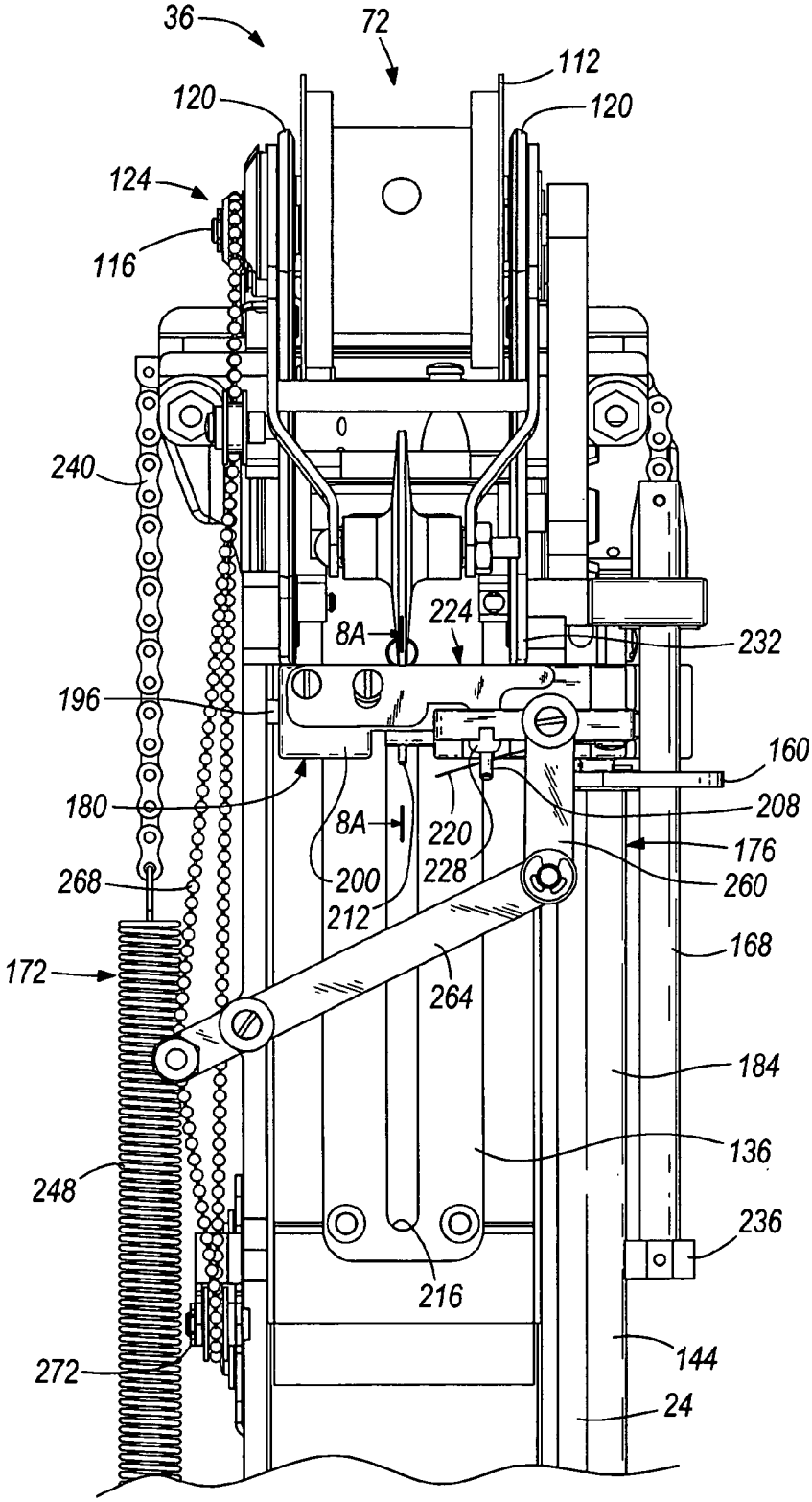
FIG. 7 is a bottom view of a portion of the taper tool shown in FIG. 1, shown with the tape advancing assembly in a forward condition.

The tape advancing assembly includes an adjustable guide and a forwardly extending rod 144, which is carried by the end of the sleeve 28 proximal the forward end 36 and slides in the adjustable guide 148, see especially FIG. 3. The adjustable guide 148 is secured to the body 24 by a band 152. The front end of the rod 144 includes a flange 160 extending therefrom. This flange 160 has an opening 164 slidably receiving a cutting rod 168 that is used for actuating the tape cutting knife 40 and corresponding cutting mechanism 172, which will be described later. The tape advancing assembly also includes an arm support structure 176 and an arm 180. The arm support structure 176 is connected to the body 24 for supporting the tape guide 136 and the arm 180. The arm support structure 176 includes a rod 184 on one side thereof and a channel 188 on the other side thereof. One end of the arm 180 includes an opening 192 in which the rod 184 is positioned and the other end of the arm 180 includes a protrusion 196 positioned in the channel 188 of the support structure 176. The arm 180 is guided forwardly and rearwardly at its ends respectively by the rod 184 and the channel 188. The arm 180 has a lateral extension 200 that underlies the tape guide 136, see also FIG. 4, and this extension 200 rockably carries a shaft 204 (see FIGS. 8A and 8B). The shaft 204 carries a release pin 208 and a tape engaging pin 212. The tape engaging pin 212 travels in a space 216 defined in the tape guide 136 when the operator moves the sleeve 28 forwardly on the body 24, causing the rod 184, the arm 180, and the shaft 204 to move forwardly. The tape advancing assembly further includes a spring 220 connected to the arm 180 and positioned rearwardly of and in engagement with the release pin 208 to bias the release pin 208 forwardly, thereby rocking the shaft 204 on its longitudinal axis to swing the tape engaging pin 212 into engagement with the tape 32 in the tape guide 136 (see FIG. 8A). The pin 212 penetrates the tape 32 and causes the tape 32 to move along the tape guide 136 toward the nozzle 108 as the sleeve 28 moves forward. FIGS. 5-7 illustrate various positions of at least some of the components of the tape advancing assembly involved in the tape advancing operation.

Figure 8A:
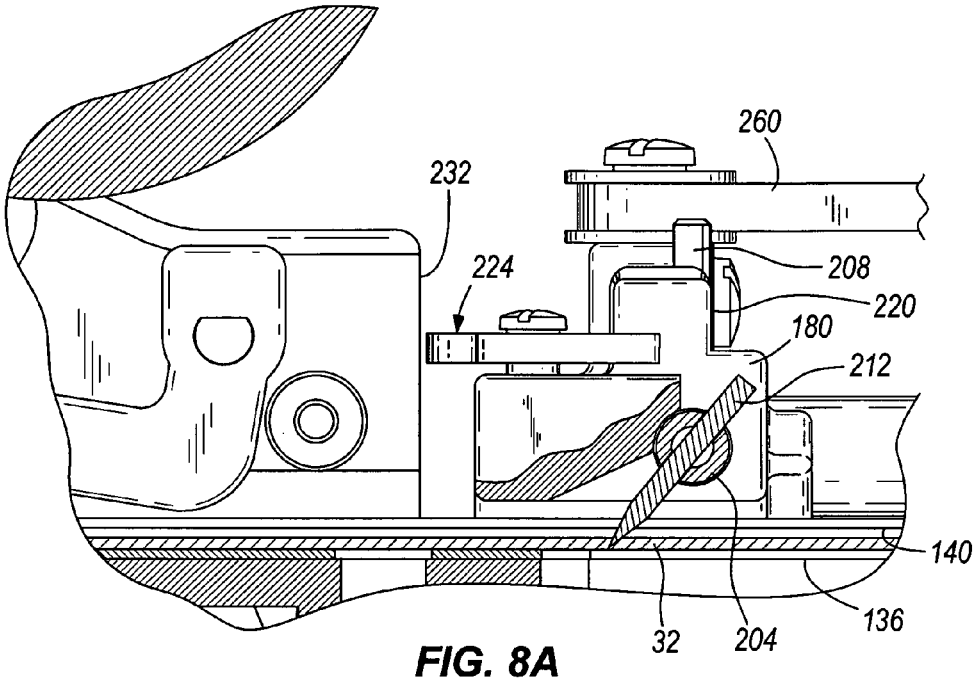
FIG. 8A is a partial cross-sectional view taken along line 8A-8A in FIG. 7, shown with a pin engaging tape.
Figure 8B:
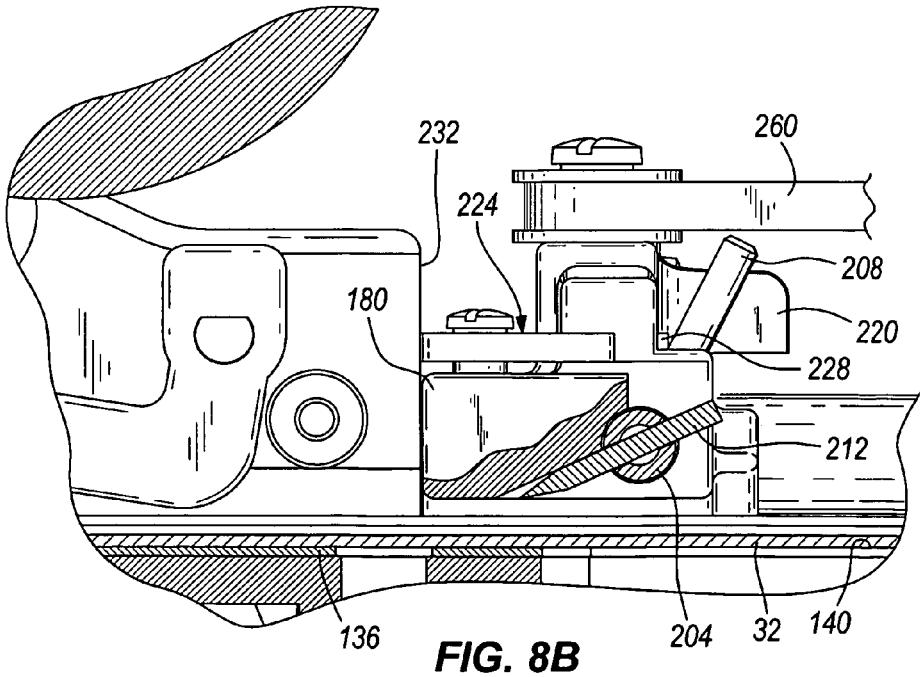
FIG. 8B is a partial cross-sectional view similar to FIG. 8A, shown with the pin disengaging the tape.

With reference to FIGS. 7 and 8B, the tape advancing assembly eventually arrives at a fully forward position (see FIG. 7) and must undergo a return stroke. A release lever 224 is rotatably connected to the arm 180 and includes an engagement portion 228 aligned with the release pin 208. As the arm 180 approaches the fully forward position, the release lever 224 engages a stopper 232 and is rotated rearwardly, thereby causing the engagement portion 228 to move the release pin 208 rearwardly against the spring 220. Rearward movement of the release pin 208 rotates the shaft 204, which causes the tape engaging pin 212 to rotate out of contact with the tape 32 (see FIG. 8*b*). Upon rearward movement of the sleeve 28, the rod 144, and the arm 180, the release lever 224 disengages the stopper 232 and the spring 220 once again biases the release pin 208 forward, thereby rotating the shaft 204 forward and causing the pin 212 to engage the tape 32. During rearward movement of these components, the tape engagement pin 212 does not penetrate the tape 32 and rides rearwardly along the tape 32. With this configuration and the lack of pin penetration, there will be no tendency for the tape engaging pin 212 to move the tape 32 in a rearward direction during the return stroke of the sleeve 28.

An operator does not have to move the tape advancing assembly through its entire forward and return strokes in order to advance the tape 32. An operator may use any increment of the forward and/or return strokes to advance the tape 32. For example, the sleeve 28 may be advanced forwardly half-way, then returned a quarter-way, then advanced completely to the furthest forward position. In other words, any forward movement of the sleeve 28, the rod 144, the arm 180, and the pins 208, 212, will cause the tape engagement pin 212 to penetrate the tape 32 and forwardly advance the tape 32, and any rearward movement of the sleeve 28, the rod 144, the arm 180, and the pins 208, 212 will cause the tape engagement pin 212 to rotate out of the tape 32 and ride along a surface of the tape 32 without moving the tape 32 rearwardly.

After the tape 32 has been advanced in the manner described above, the taper tool 20 is ready for tape and mastic application. During actual application of tape 32 and mastic to a wall surface, the drive roller 112 is the driving force for advancing the tape 32. The tape 32 is compressed against the wall surface by the drive roller 112 and is advanced as the drive roller 112 rolls against the wall surface.

Figure 10:
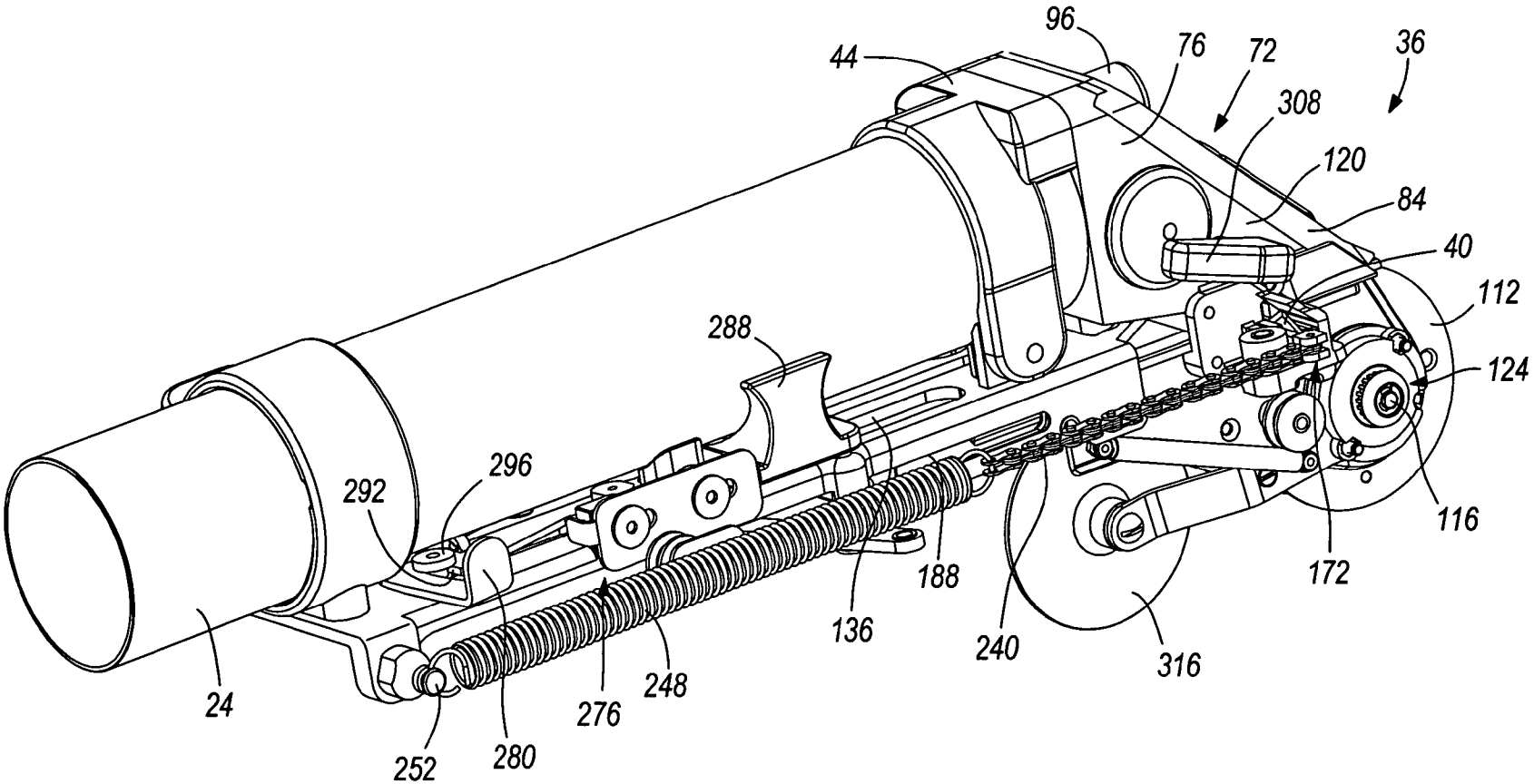
FIG. 10 is a top perspective view of the taper tool shown in FIG. 1, shown with a tape guide advancing assembly.
Figure 11:
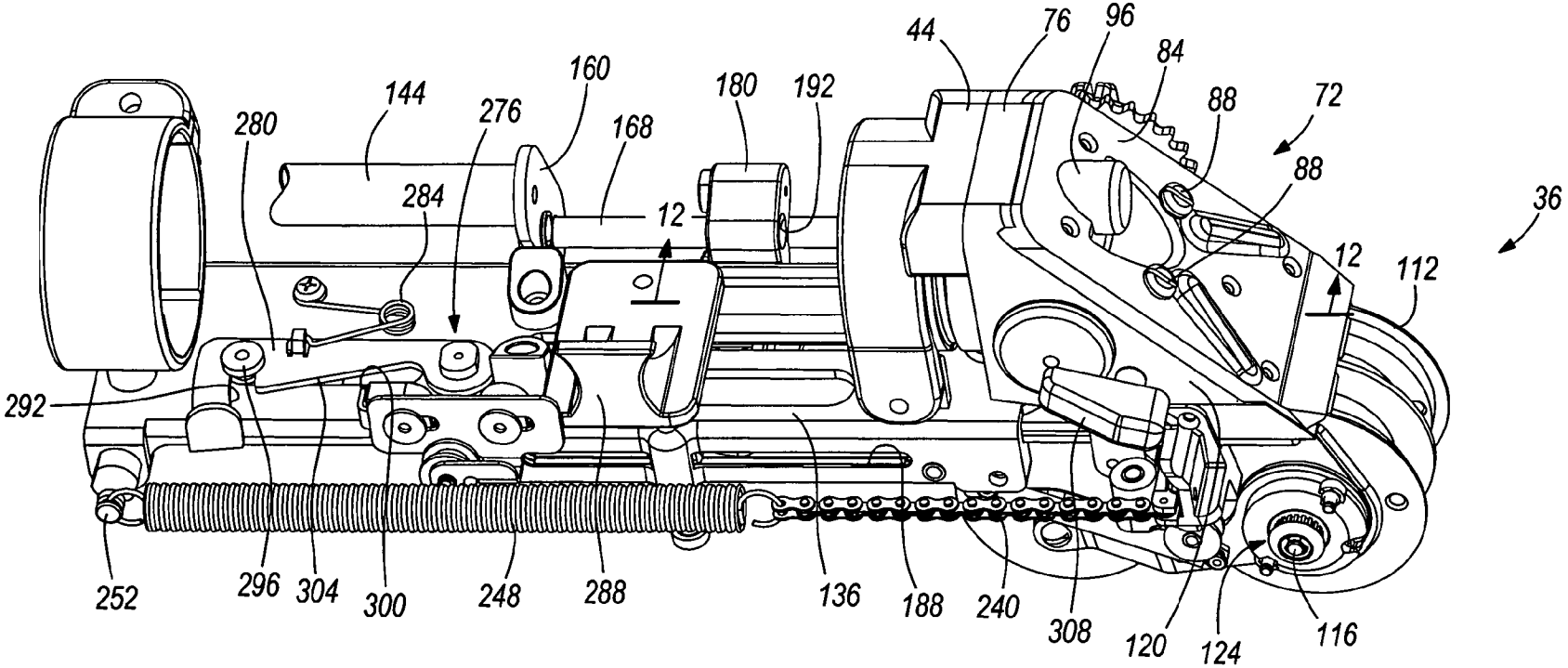
FIG. 11 is a top perspective view of the taper tool shown in FIG. 1, shown with a body of the taper tool removed and the tape guide advancing assembly in a retracted condition.

Referring now to FIGS. 1-5, the tape cutting mechanism will be described. After the operator finishes applying tape 32 and mastic to a wall or the like, the next act is to sever the tape 32. This is accomplished by moving the sleeve 28, along the body 24, in a rearward direction. An operator will grasp the sleeve 28 with one hand and use the other hand to grasp the body 24. As mentioned above, forward movement of the sleeve 28 moves the rod 144, the flange 160, and the arm 180 forward. However, when the sleeve 28 is moved toward the rear of the body 24, the rod 144 and flange 160 move rearwardly. As described above, the flange 160 includes an opening 164, which receives the cutting rod 168. The cutting rod 168 includes an enlarged portion 236 sized larger than the opening 164 in the flange 160 so that the flange 160 engages the enlarged portion 236 during rearward movement thereof. Accordingly, rearward movement of the sleeve 28, the rod 144, and the flange 160 moves the cutting rod 168 rearward. The front end of the cutting rod 168 is connected to a first end of a cutting chain 240. The cutting chain 240 passes through a cutting channel 244 (see FIGS. 12 and 14) defined in the taper head 72 and connects, at its second end, to a first end of a spring 248. The second end of the spring 248 connects to a spring protrusion 252 on the arm support structure 176. A tape cutting knife 40 (see FIGS. 10, 12, and 14) connects to the chain 240 within the taper head and aligns with the cutting channel 244. When the chain 240 is in a normal, at-rest position, the knife 40 will be disposed to a side of the cutting channel 244 adjacent the spring 248. When the sleeve 28 moves rearwardly to pull both the rods 144, 168 rearwardly, the cutting rod 168 pulls on the chain 240, which moves the knife 40 laterally across the channel 244 to sever the tape 32.

During the tape cutting movement, the chain 240 will pull on the spring 248, thereby increasing the force of the spring 248 on the chain 240. When the cutting operation is complete and the operator reduces the amount of rearward force on the sleeve 28 to the extent that the rearward force is less than the spring force, the spring 248 will pull the sleeve 28 and the rod 168 forward via the chain 240 to their neutral, at rest position.

After each tape cutting operation, it is necessary to forwardly advance the leading end of the tape 32 from the cutting position to the drive roller 112 for the next application of tape 32. Also, it is necessary to apply mastic to the leading end of the tape 32 as it passes the nozzle 108 on its way to the drive roller 112. The taper tool 20 of the present invention is capable of simultaneously advancing a leading end of the tape 32 toward the drive roller 112 and applying mastic to the leading end of the tape 32.

With particular reference to FIGS. 2 and 4-7, the mastic application assembly is coupled between the tape advancing assembly and the shaft 116 of the drive roller 112. The mastic application assembly enables mastic to be applied to the tape 32 as the tape 32 is forwardly advanced by the tape advancing assembly. The mastic application assembly further includes a first link 260 and a second link 264. The first link 260 is pivotally connected, at a first end, to the arm 180 and pivotally connected, at a second end, to a first end of the second link 264. The second link 264 is pivotally connected, near a second end thereof, to the arm support structure 176. Although the mastic application assembly includes two links as shown and described, the mastic application assembly can include one or more links and perform similar operations. The mastic application assembly also includes a transfer member 268 coupled to the second end of the second link 264 and wrapped around a pulley 272 mounted on the arm support structure 176 and a unidirectional clutch 124 in communication with the shaft 116 of the drive roller 112. In the illustrated embodiment, the transfer member 268 is a beaded chain. Alternatively, the transfer member 268 could be a wire, a linked chain, or any other apparatus that operates in a manner similar to that of the illustrated transfer member. Rotation of the clutch 124 in a forward direction rotates the drive roller 112, while rotation of the clutch 124 in a rearward direction does not enable rotation of the drive roller 112. As described above, rotation of the drive roller 112 in a forward direction facilitates extrusion of mastic from the nozzle 108.

With continued references to FIGS. 2 and 4-7, operation of the mastic application assembly as it relates to operation of the taper tool 20 will be described. Referring particularly to FIG. 5, the mastic application assembly is shown in a rearward condition. As described above, forward advancement of the sleeve 28 forwardly advances the arm 180 and connected components, thereby forwardly advancing the tape 32 and the mastic application assembly. Referring particularly to FIG. 6, the mastic application assembly is shown in an intermediate condition with the arm 180 advanced and the two links 260, 264 rotated from their original positions. Rotation of the second link 264 in the manner illustrated and described moves the transfer member 268 rearwardly (as viewed in FIGS. 5-7), which causes the clutch 124 and the drive roller 112 to forwardly rotate, thereby secreting mastic from the nozzle 108 onto the advancing tape 32. Referring to FIG. 7, the mastic application assembly is shown in a forwardly advanced condition, thereby further moving the transfer member 268 in a rearward direction to further rotate the drive roller 112 and secrete additional mastic onto the continually advancing tape 32. Accordingly, forward advancement of the sleeve 28 simultaneously and automatically advances tape 32 and applies mastic to the advancing tape 32. On the return stroke, rearward movement of the sleeve 28 pulls the arm 180 and the mastic application assembly rearward, thereby rotating the two links 260, 264 in an opposite direction and moving the transfer member 268 in an opposite (forward) direction. Movement of the transfer member 268 in the opposite direction rotates the clutch 124 in a rearward direction, but due to the unidirectional feature of the clutch 124, the clutch rotates relative to the drive roller 112 without rearwardly rotating the drive roller 112. Accordingly, the drive roller 112 does not rotate on the return stroke and mastic is not secreted. Forward advancement of the sleeve 28 will again cause the drive roller 112 to forwardly rotate.

With reference to FIGS. 10-14, the taper tool 20 includes a jam clearing assembly or tape guide advancing assembly 276 for advancing the tape guide 136 to clear tape jams that may have occurred along the path of the tape 32. In some instances, tape jams can occur from tape slivers created by the cutting knife 40. Such tape slivers can be created when the tape 32 slightly shifts forward after being cut, but prior to the knife 40 returning to its at rest condition via its return stroke. On the return stroke of the knife 40, the knife 40 cuts the portion of the tape 32 shifted forward of the cutting plane, thereby creating a tape sliver. Such tape slivers can accumulate in and around the cutting channel 244 or anywhere along the tape path and inhibit travel of the tape 32 through the taper head 72. Sufficient accumulation of tape slivers along the tape path can altogether stop travel of the tape 32 through the taper head 72.

Figure 13:
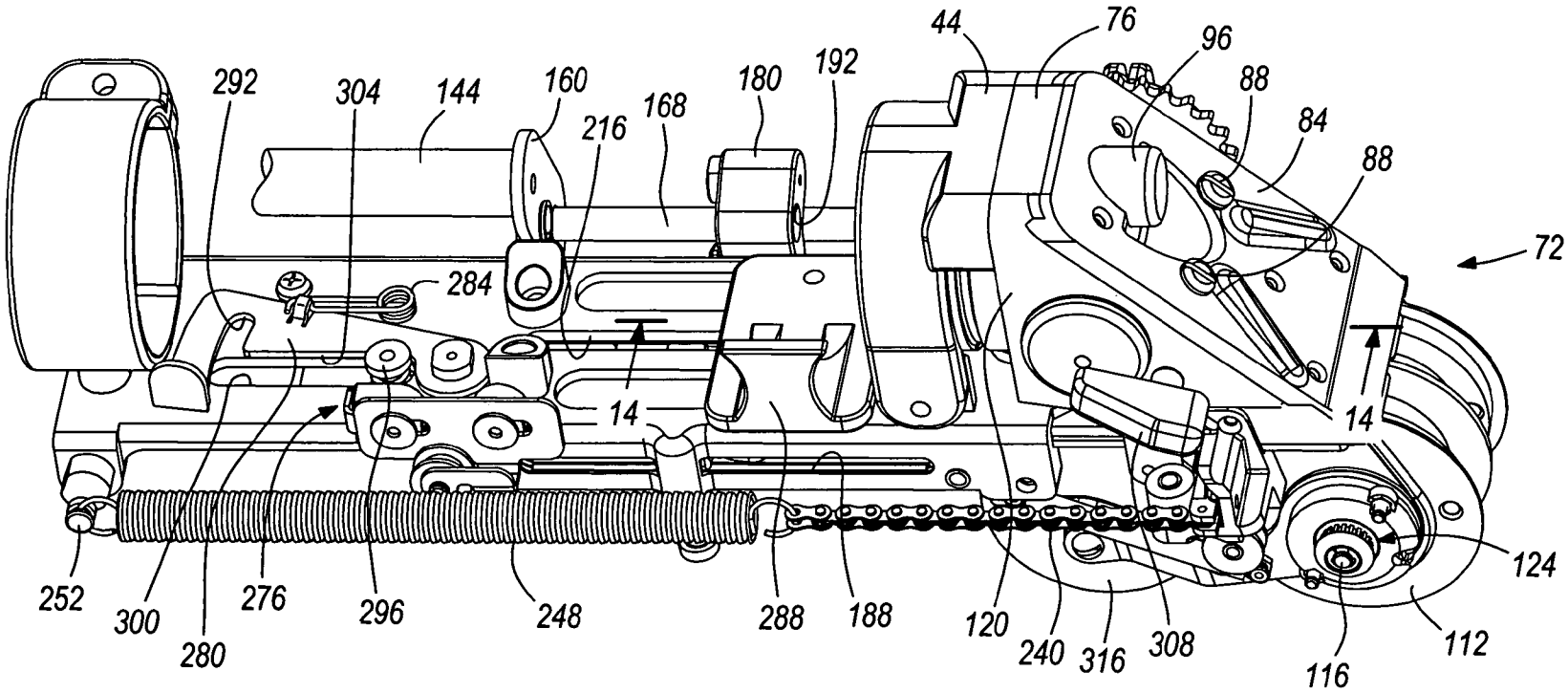
FIG. 13 is a top perspective view of the taper tool similar to FIG. 11, shown with the tape guide advancing assembly in an advanced condition.

The tape guide advancing assembly 276 includes the tape guide 136, which is moveable between a rearward position (see FIGS. 10-12) and an advanced position (see FIGS. 13 and 14). The tape guide advancing assembly 276 also includes an actuator 280, an actuator spring 284 and a lever 288. The actuator 280 is engageable by an operator to move the actuator 280 between a locked condition and an unlocked condition. A slot 292 is defined in the actuator 280 for selectively receiving a post 296 of the tape guide 136. The post 296 is positioned in and moveable along a slot 300 defined in the arm support structure 176. The lever 288 is connected to the tape guide 136 and is moveable forwardly and rearwardly by an operator to move the tape guide 136 forwardly and rearwardly. In the locked condition, the actuator 280 is biased outwardly by the actuator spring 284 and the post 296 is positioned within the slot 292 to prevent advancement of the tape guide 136. After an operator moves the actuator 280 to the unlocked condition, the post 296 is free of the slot 292 to enable advancement of the tape guide 136. An operator can grasp and move the lever 288 to forwardly advance the tape guide 136 past the cutting position and toward the drive roller 112. Any slivers or other jam causing debris positioned in the tape path are pushed from the tape path and out of the front of the taper head by the forwardly advancing tape guide 136. An operator returns the tape guide 136 to its original position by moving the lever 288 rearwardly. The post 296 cams against an angled surface 304 of the actuator 280 as it moves rearwardly, thereby moving the actuator 280 against the force of the actuator spring 284 and out of the path of the post 296. When the post 296 passes the angled surface 304 of the actuator 280 and aligns with the slot 292, the actuator spring 284 biases the actuator 280 back to the locked condition and positions the post 296 within the actuator slot 292. In some embodiments, the taper tool 20 is disabled from advancing tape 32 and applying mastic when the actuator 280 is in the unlocked condition.

Operation of the separate mechanisms have been described in the general descriptions above. However, complete operation of the taper tool 20 will be described hereafter to better illustrate how the separate mechanisms operate together to perform a complete operation of the taper tool 20.

The tool body 24 can be filled with mastic by first actuating a handle 308 for closing a gate valve 312 (see FIGS. 9, 12, and 14), which closes the outlet of the nozzle 108. At the same time, the rotatable shaft 132 will be decoupled from the drive roller 112. The mastic, as it enters the filler tube 96, will open the filler valve 52 and flow into the body 24 and move the piston (not shown) to the rear end of the body 24. When this is completed, the filler valve 52 will close and the operator actuates the handle 308 to open the gate valve 312, and the rotatable shaft 132 will again be coupled to the drive roller 112. The operator can rotate the drive roller 112 to move the piston forward to force out any air pockets in the mastic.

Next, the operator feeds the tape 32 into the tape guide 136, and then moves the sleeve 28 forwardly on the body 24, causing the pin 212 to penetrate the tape 32, see FIG. 8A, and move the tape 32 forwardly toward the drive roller 112. Forward movement of the sleeve 28 also actuates the mastic application assembly, thereby causing the drive roller 112 to rotate and secrete mastic from the nozzle 108 onto the leading edge of the advancing tape 32. The tape 32 is advanced until the tape 32, with mastic thereon, is positioned on the drive roller 112. Once the tape 32 with mastic thereon is positioned on the drive roller 112, it is ready to be applied to a wall surface. In some instances, numerous reciprocations of the sleeve 28 maybe necessary to appropriately advance the tape 32 to the drive roller 112. If this is the case, on the return stroke of the sleeve 28, the pin 212 will be pulled from the tape 32, thereby eliminating any tendency for the tape 32 to be pulled rearwardly.

The taper tool 20 is now ready to apply the tape 32 and the layer of mastic to a wall surface. The drive roller 112 rotates as it travels along the wall and applies the tape 32 and mastic to the wall surface. The tape 32 will be fed by the drive roller 112 and the piston (not shown) will force mastic onto the tape 32.

At the end of the application (i.e., at the top or bottom of a wall joint), the operator moves the sleeve 28 rearwardly on the body 24, causing the knife 40 to traverse the cutting channel 244 and cut the tape 32. The spring 248 returns the knife 40 to its starting position after the cutting operation.

The taper tool 20 also includes a tape creasing disc 316 for applying the tape 32 and mastic to an inner corner of a room. Operation of the tape creasing disc 316 is known in the art and will not be discussed in further detail herein.

During operation of the taper tool 20, a tape jam may occur within the path of the tape 32. In such an instance, it is desirable to quickly clear the jam and continue operation of the taper tool 20. The taper tool 20 includes the tape guide advancing assembly 276 to clear such tape jams. An operator depresses the actuator 280 to move the actuator 280 from the locked condition to the unlocked condition. Upon positioning the actuator 280 in the unlocked condition, the operator grasps the lever 288 and forwardly moves the lever 288, thereby forwardly moving the tape guide 136 along the tape path toward the drive roller 112. The debris causing the jam is pushed out of the front of the taper head 72 by the forwardly advancing tape guide 136. After advancement of the tape guide 136, the operator rearwardly moves the lever 288, thereby rearwardly moving the tape guide 136. The lever 288 and tape guide 136 are moved rearwardly until the post 296 is positioned in the actuator slot 292 and the actuator 280 returns to the locked condition. In some instances, several cycles of tape guide advancement may be required to clear a jam. In such instances, the operator can depress and hold the actuator 280 in the unlocked condition while repeatedly cycling the tape guide 136. When the jam is cleared, the operator can release the actuator 280 and return the actuator 280 and tape guide 136 to the locked condition.

Mastic build-up in the head assembly of the taper tool 20 can inhibit efficient operation of the taper tool 20. Therefore, it is desirable to clean the head of the taper tool 20 after or between uses thereof. To clean the taper head 72, an operator simply loosens the fasteners 88, which enables removal of the cover plate 84 and filler tube 96 from the taper head 72. With the cover plate 84 and filler tube 96 removed, the operator has access to the interior of the head housing 76 and the filler valve 52. In addition, the filler tube 96 is disconnectable from the cover plate 84 by removing the fastener 100, thereby allowing additional cleansing of the filler tube 96. Upon completely cleaning the taper head 72, the taper head 72 can be re-assembled in a reverse manner to that described above.

Figure 15:
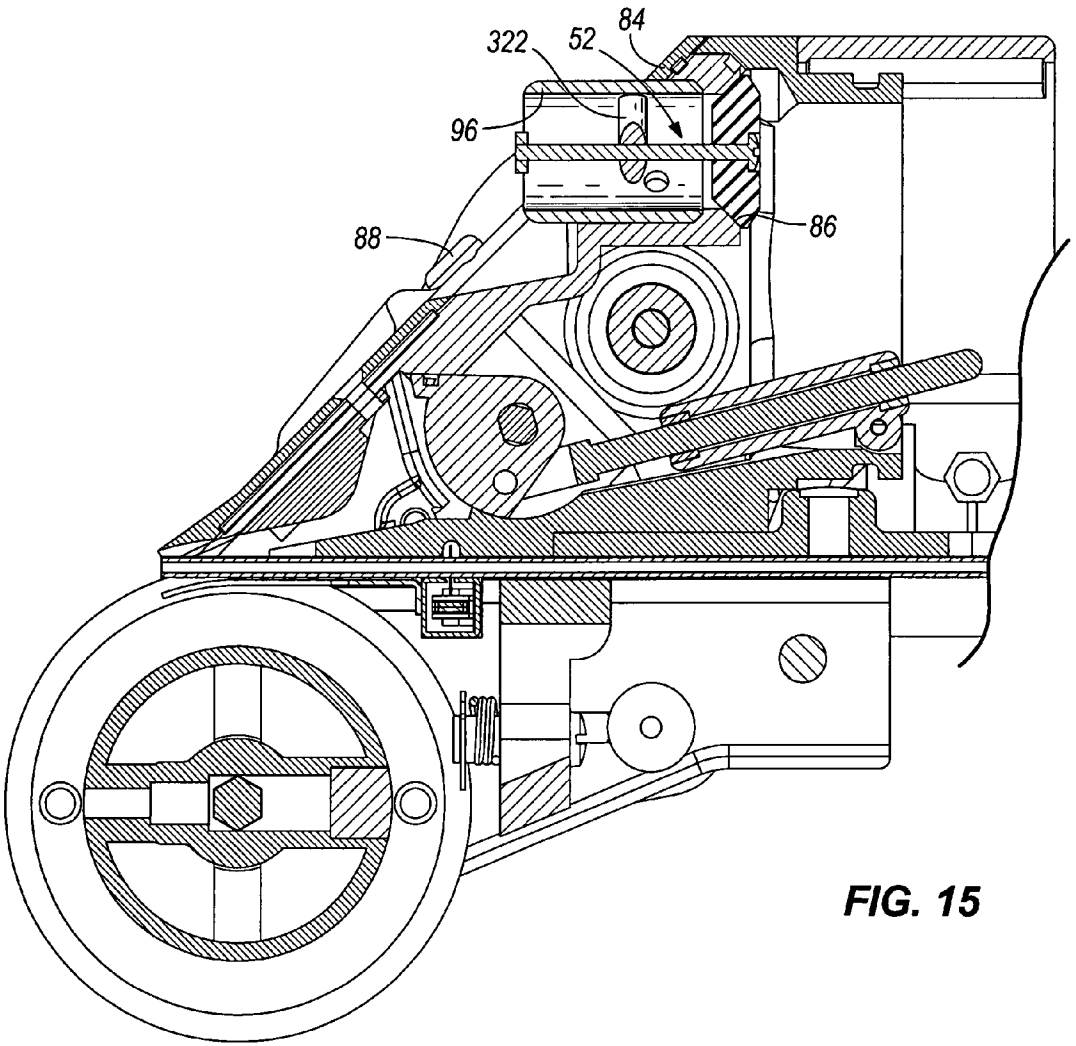
FIG. 15 is a cross-sectional view of an alternative embodiment of a taper head of a taper tool, shown with a valve in a closed position.
Figure 16:
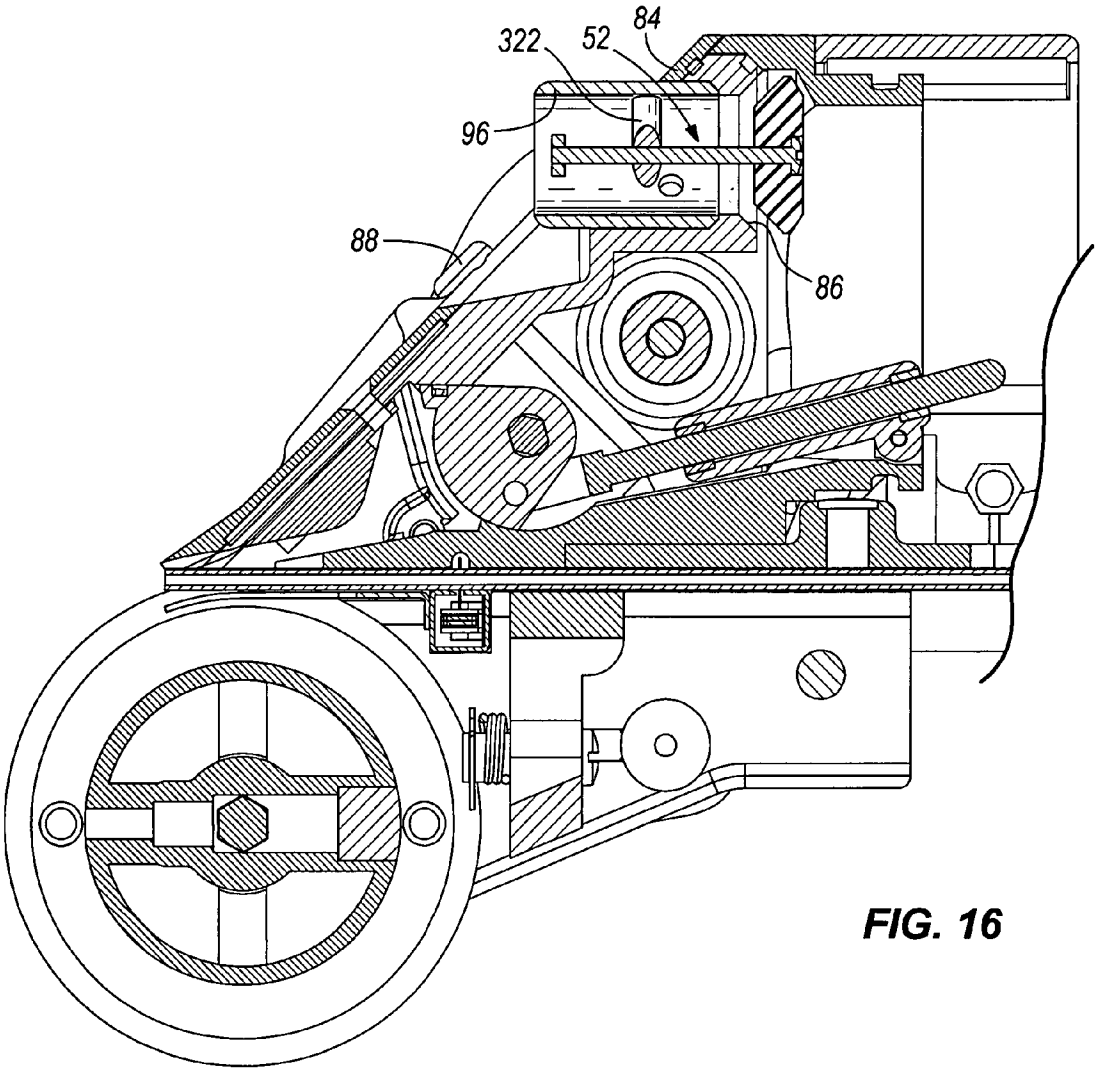
FIG. 16 is a cross-sectional view similar to the cross-sectional view of FIG. 15, shown with the valve in an open position.
Figure 17:
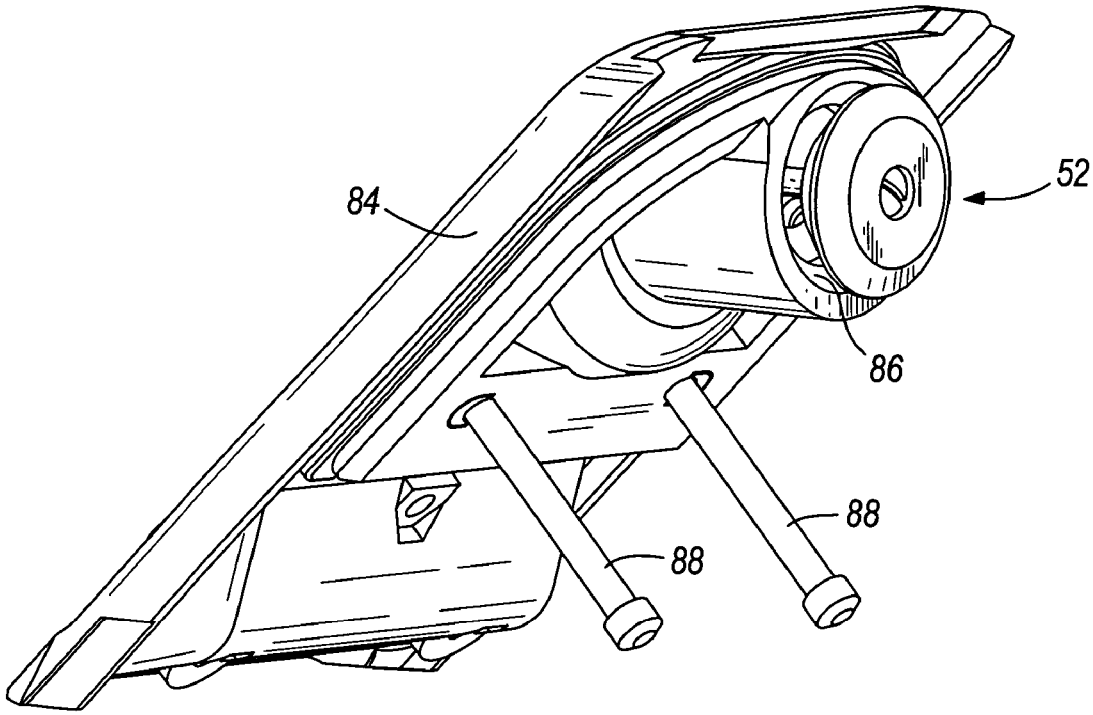
FIG. 17 is a perspective view of a cover plate and the valve shown in FIGS. 15 and 16, shown with the valve in the open position.

With reference to FIGS. 15-17, an alternative embodiment of a portion of the taper head 72 is illustrated. The taper tool 20 including this alternative embodiment of the taper head 72 is similar to the embodiment of the taper tool 20 previously described and illustrated except for the differences described below and illustrated in FIGS. 15-17. In this embodiment, the filler valve 52 is connected to the filler tube 96 and is moveable between a closed position (see FIG. 15), in which the valve 52 engages the valve seat 86 of the cover plate 84, and an open position (see FIG. 16), in which the valve 52 is displaced from the valve seat 86. The valve 52 is biased toward the closed position by a spring (not shown). A valve support 322 is connected to the interior of the filler tube 96 to support the valve 52 and allow sliding movement of the valve 52 between the open and closed positions. In the closed position, the valve 52 prevents mastic from escaping the taper head 72 or the body 24 through the filler tube 96. Forced injection of mastic into the filler tube 96 moves the valve 52 against the spring into the open position and allows the body 24 of the taper tool 20 to be filled with mastic. When the body 24 is filled with mastic to the desired amount, the valve 52 is biased back to the closed position to again create a seal.

Figure 18:
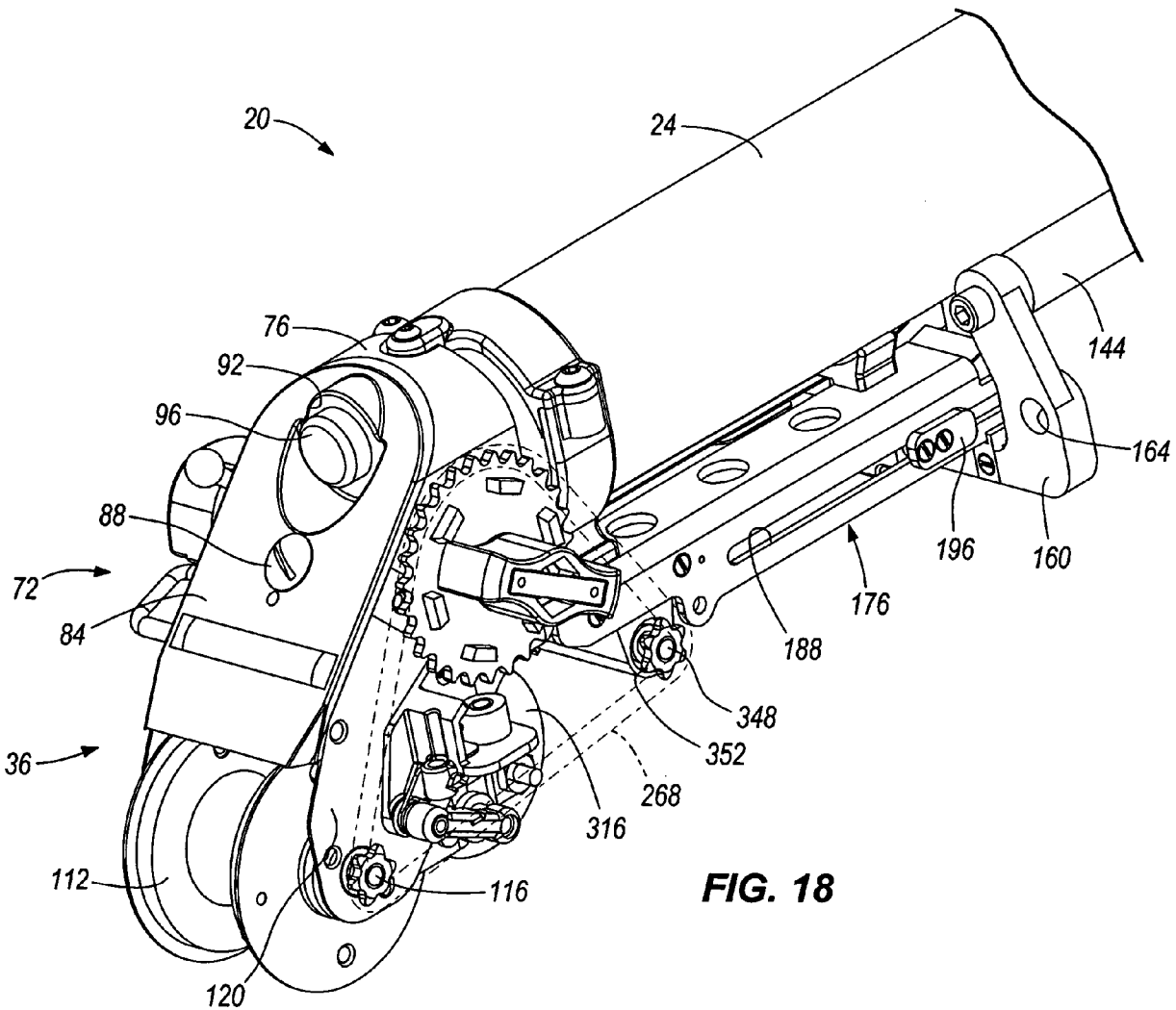
FIG. 18 is a top perspective view of an alternative embodiment of a taper tool, shown with some components removed to simplify viewing.
Figure 19:
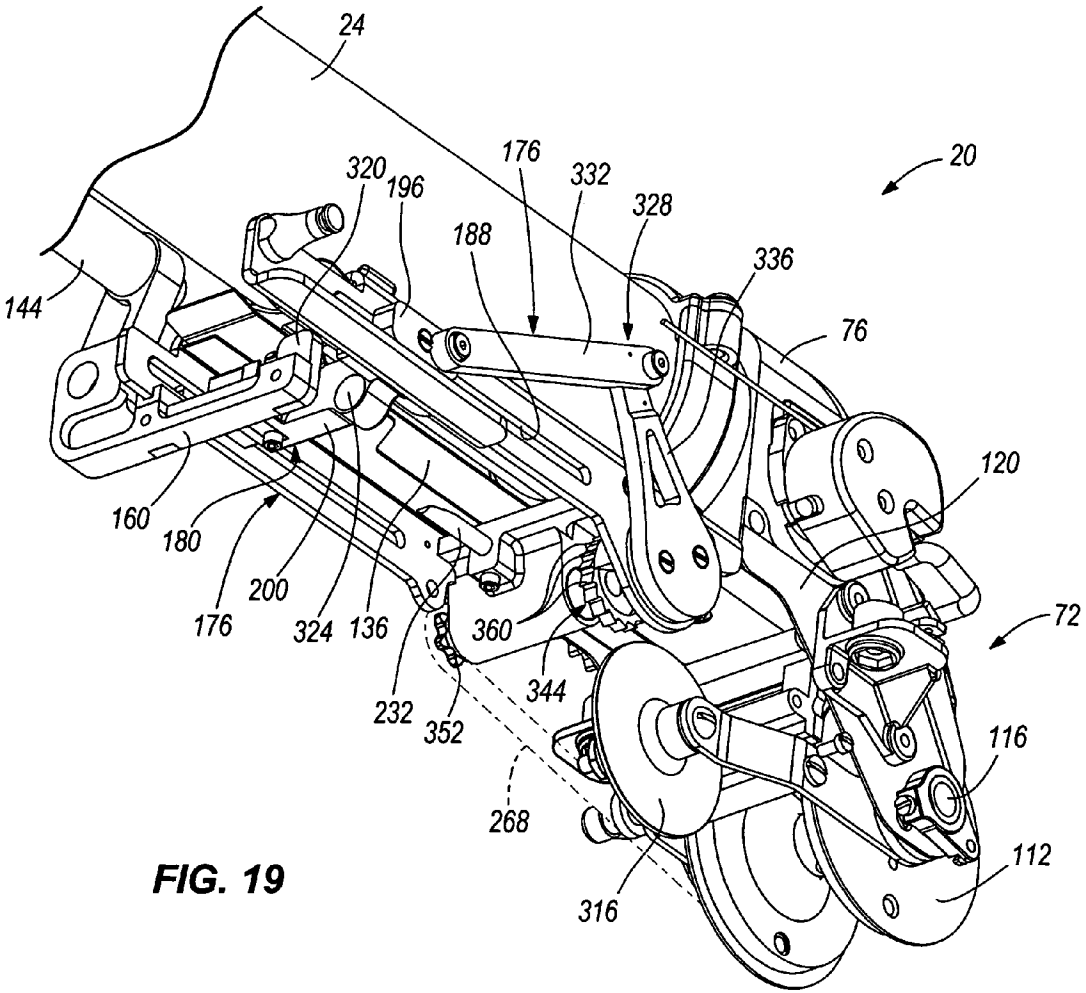
FIG. 19 is a bottom perspective view of the taper tool shown in FIG. 18.
Figure 20:
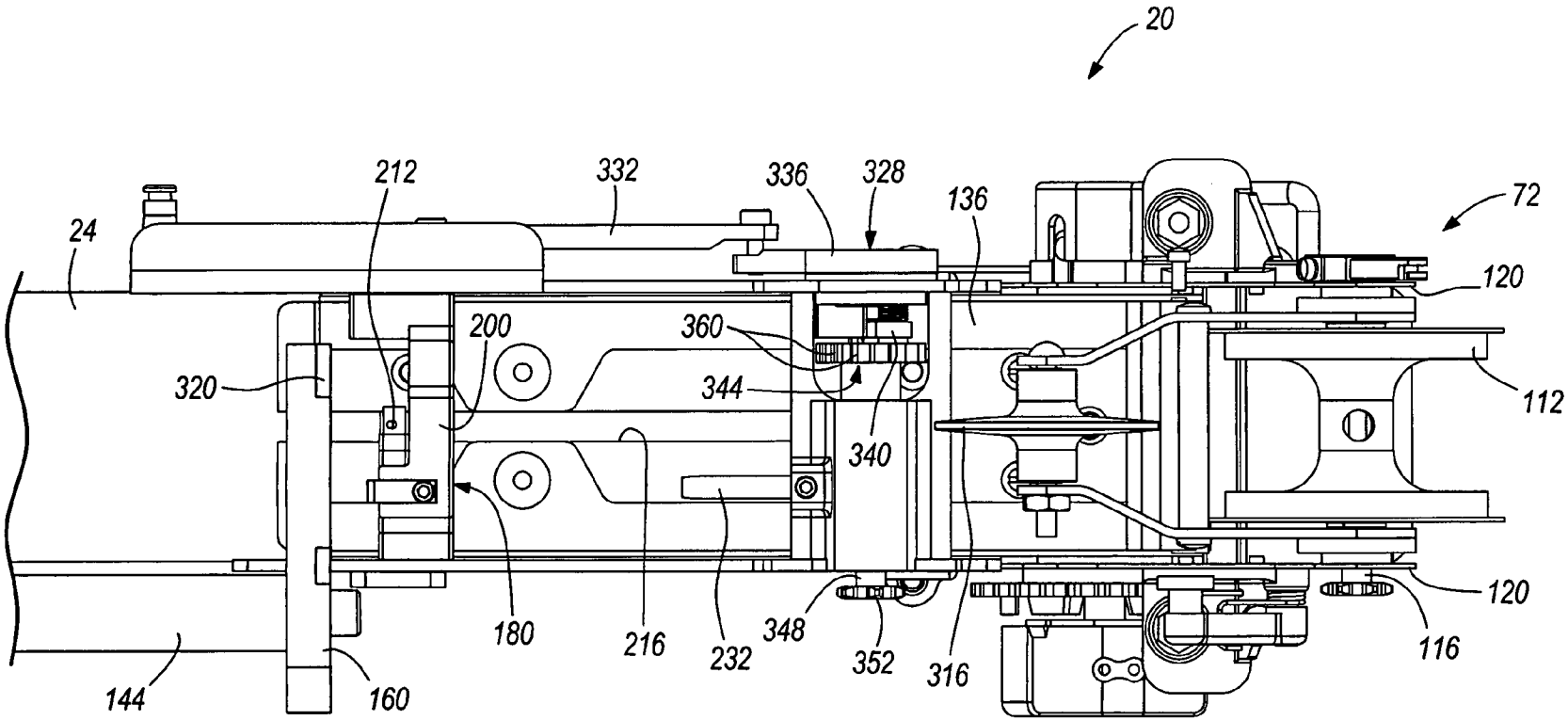
FIG. 20 is an enlarged bottom view of a ratchet mechanism of the taper tool shown in FIG. 18.

With reference to FIGS. 18-20, a first alternative embodiment of the taper tool 20 is illustrated. More particularly, the taper tool 20 includes an alternative mechanism for simultaneously and automatically advancing tape 32 and applying mastic to the tape 32. Similar components between embodiments are represented with similar reference numbers.

The taper tool 20 includes a forwardly extending rod 144 and a flange 160 connected to a forward end of the rod 144. A metal tab 320 is connected to the flange 160 and cooperates with a magnet 324 connected to the arm 180. Alternatively, the metal tab 320 can be connected to the arm 180 and the magnet 324 can be connected to the flange 160. The mastic application assembly includes a ratchet mechanism 328 including a first link 332 connected, at a first end, to the arm 180 and, at the second end, to a second link 336. The second link 336 is coupled, at a second end, to a ratchet lever 340 and a ratchet wheel 344. The ratchet wheel 344 is connected to a first end of a ratchet shaft 348, and a drive gear 352 is connected to a second end of the shaft 348. The drive gear 352 is coupled to a transfer member 268, which wraps around the drive shaft 116 of the drive roller 112.

Tape advancing and mastic application operations will now be described for the first alternative embodiment. After cutting the tape 32 or upon initial feeding of the tape 32 into the taper head 72, it is desirable to advance the leading edge of the tape 32 toward the drive roller 112 and apply mastic to the tape 32 as it advances toward the drive roller 112. To advance the tape 32, the sleeve 28 is slid forwardly along the body 24, thereby forwardly moving the rod 144 and the flange 160 into engagement with the arm 180. The metal tab 320 is aligned with the magnet 324 and magnetically connects the flange 160 to the arm 180. An operator continues to slide the sleeve 28 forward, which causes the flange 160 to force the arm 180 forward. Due to the penetration of the pin 212 through the tape 32, the tape 32 advances forwardly with the arm 180. As the arm 180 approaches a fully advanced position, a release portion (not shown) of the arm 180 engages the stopper 232, thereby rotating the shaft 204 and removing the pin 212 from engagement with the tape 32. The sleeve 28 and the tape advancing assembly can now be moved rearwardly without pulling the tape 32 rearwardly. Rearward movement of the sleeve 28 moves the rod 144 and flange 160 rearwardly. The magnetic connection between the flange 160 and the arm 180 is sufficient to sustain connection therebetween as the flange 160 is moved rearwardly, thereby rearwardly moving the arm 180. The arm 180 has a fully rearward position, in which the arm 180 cannot move any further rearwardly. The magnetic connection between the flange 160 and the arm 180 is weak enough to enable separation of the flange 160 and the arm 180 as the arm 180 reaches the fully rearward position to allow further rearward movement of the sleeve 28 for actuation of the cutting mechanism of the taper tool 20.

To automatically apply mastic to the advancing tape 32, forward movement of the arm 180 moves the first link 332 in a forward direction to forwardly rotate the second link 336. The second link 336 engages the ratchet lever 340, thereby causing the ratchet lever 340 to rotate forwardly. The ratchet wheel 344 includes a plurality of teeth 360, which are engageable by the ratchet lever 340. The ratchet lever 340 engages one of the ratchet teeth 360, and forward rotation of the ratchet lever 340 rotates the ratchet wheel 344 forward. Forward rotation of the ratchet wheel 344 causes the ratchet shaft 348 to rotate, thereby rotating the drive gear 352 connected to the second end of the ratchet shaft 348. The rotating drive gear 352 drives the transfer member 268, which causes rotation of the drive roller shaft 116 and the drive roller 112. Rotation of the drive roller 112 secretes mastic from the nozzle 108 and onto the advancing tape 32. On the return stroke of the sleeve 28 and connected elements, the arm 180, the first link 332, the second link 336, and the ratchet lever 340 return to their original positions. On the return stroke of the ratchet lever 340, the ratchet lever 340 ratchets over the teeth 360 of the ratchet wheel 344 in a rearward direction, thereby preventing positive engagement between the ratchet lever 340 and the teeth 360, which would cause rearward rotation of the ratchet wheel 344. Forward movement of the sleeve 28 and connected elements will again positively engage the ratchet lever 340 with the teeth 360 to forwardly rotate the ratchet wheel 344.

Figure 21:
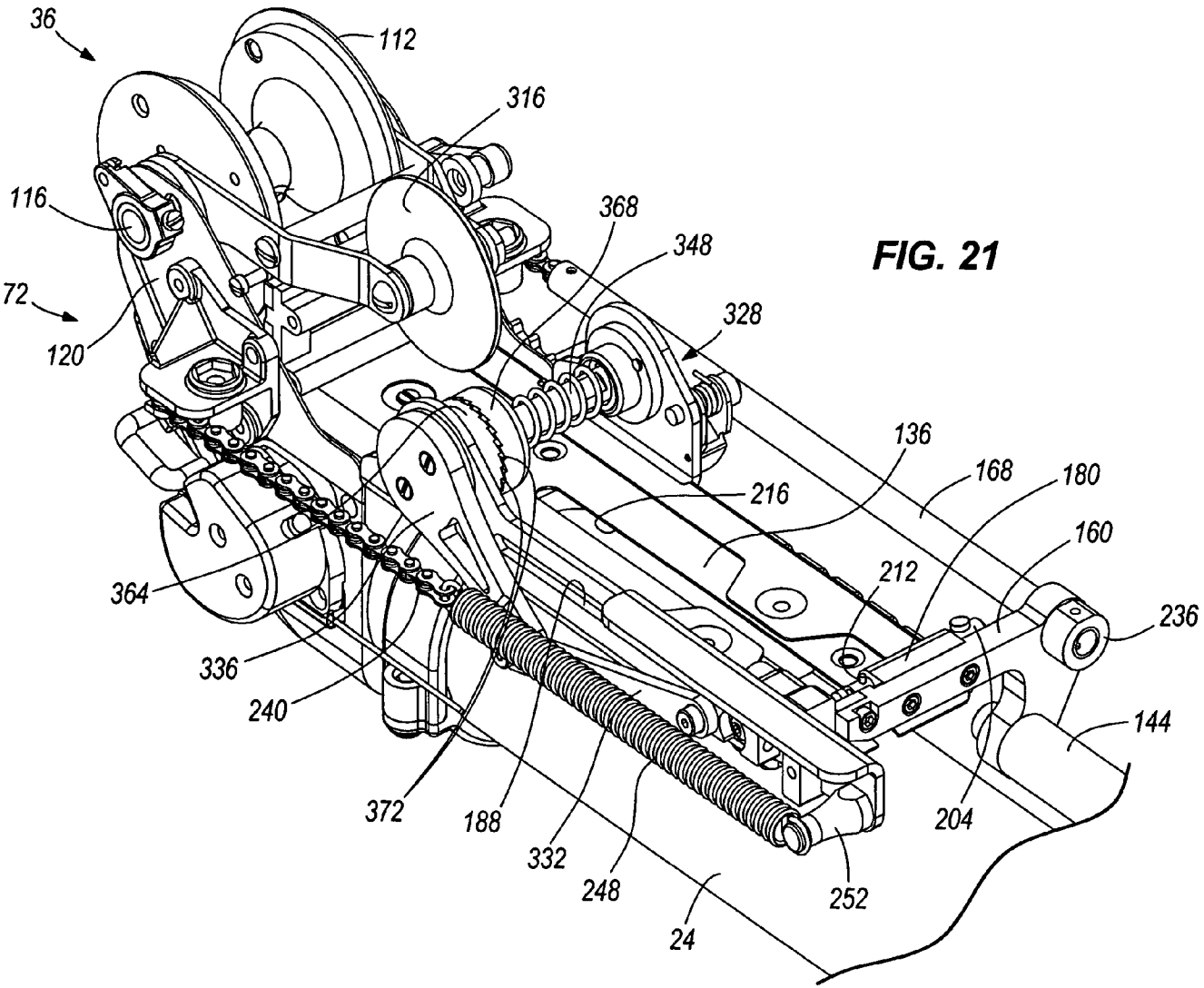
FIG. 21 is a bottom perspective view of the taper tool shown in FIG. 18, shown with an alternative embodiment of the ratchet mechanism.

With reference to FIG. 21, a second alternative embodiment of the taper tool 20 is illustrated. More particularly, another embodiment of the ratchet mechanism is shown and described herein. Similar components between embodiments are represented with similar reference numbers. The ratchet mechanism includes a first ratchet wheel 364 and a second ratchet wheel 368. Each wheel includes a set of ratchet teeth 372 disposed on adjacent faces thereof. Forward advancement of the sleeve 28 and connected components forwardly rotates the first ratchet wheel 364. The teeth 372 of the first ratchet wheel 364 positively engage the teeth 372 of the second ratchet wheel 368, thereby rotating the second ratchet wheel 368 in a similar, forward direction. Rotation of the second ratchet wheel 368 rotates the ratchet shaft 348 and the drive gear 353, which causes the drive roller 112 to rotate via the transfer member 268, thereby secreting mastic onto the advancing tape 32. Rearward movement of the sleeve 28 and connected components rotates the first ratchet wheel 364 rearwardly. However, due to the shape of the ratchet teeth of both the first and second ratchet wheels 364, 368, the teeth of the first ratchet wheel 364 slide over the teeth of the second ratchet wheel 368. Accordingly, the second ratchet wheel 368 is not rearwardly rotated by the first ratchet wheel 364. Forward movement of the sleeve 28 and connected components once again causes engagement between the teeth of the first and second ratchet wheels 364, 368, thereby rotating the first and second ratchet wheels 364, 368 and secreting additional mastic onto the advancing tape 32.

Preferred embodiments of this invention are described herein. Variations of those preferred embodiments may become apparent to those of ordinary skill in the art upon reading the foregoing description. Accordingly, this invention includes all modifications and equivalents of the subject matter recited in the claims appended hereto. Moreover, any combination of the above-described elements in all possible variations thereof is encompassed by the invention. The scope of the invention, not being limited to the described embodiments, is set forth in the appended claims.

We claim:

1. A taper tool comprising:

a body for holding a supply of mastic;

a spool assembly for supporting a spool of tape;

a drive roller positioned at an end of the taper tool, the tape being feedable from the spool of tape and at least partially around the drive roller to be applied to a wall surface;

an actuator supported by and moveable along the body;

a tape advancing assembly including a transfer member engageable with the drive roller, the tape advancing assembly coupled to the actuator and engageable with the tape to advance the tape toward the drive roller; and a mastic application assembly connected to the tape advancing assembly, coupled to the actuator, and operable to apply mastic to the tape;

wherein movement of the actuator moves the tape assembly to advance the tape toward the drive roller and actuates the mastic application assembly to rotate the drive roller via the transfer member to force mastic from the body and onto the advancing tape.

2. The taper tool of claim 1, wherein the mastic application assembly further comprises at least one link pivotal relative to the tape advancing assembly, the transfer member being coupled to the at least one link.

3. The taper tool of claim 2, wherein the mastic application assembly further comprises a first link and a second link, the first link being pivotally connected, at a first end, to the tape advancing assembly and being pivotally connected, at a second end, to a first end of the second link, the transfer member being connected to the second link.

4. The taper tool of claim 3, further comprising a pulley, and wherein the transfer member is rigidly connected to the second link and couples a shaft of the drive roller and the pulley.

5. The taper tool of claim 1, wherein movement of the actuator in a first linear direction moves the tape advancing assembly in the first linear direction to advance the tape and actuates the mastic application assembly to force mastic from the body and onto the advancing tape, and wherein movement of the actuator in a second linear direction moves the tape advancing assembly in the second linear direction, the tape not advancing or retracting and the mastic not being forced from the body during movement of the actuator in the second linear direction.

6. The taper tool of claim 5, wherein movement of the actuator in the first linear direction actuates the mastic application assembly to rotate the drive roller in a first rotational direction via the transfer member, thereby forcing mastic from the body and onto the advancing tape, and wherein movement of the actuator in the second linear direction actuates the mastic application assembly to rotate the drive roller in a second rotational direction via the transfer member.

7. The taper tool of claim 1, wherein the mastic application assembly comprises a ratchet mechanism coupled to the actuator, wherein movement of the actuator in a first linear direction actuates the ratchet mechanism which enables mastic to be applied to the tape.

8. The taper tool of claim 1, wherein the actuator is a sleeve.

9. A taper tool comprising:

a body for holding a supply of mastic;

a spool assembly for supporting a spool of tape;

a drive roller positioned at an end of the taper tool, the tape being feedable from the spool of tape and at least partially around the drive roller to be applied to a wall surface;

an actuator supported by and moveable along the body;

a tape advancing assembly coupled to the actuator and engageable with the tape to advance the tape toward the drive roller; and a mastic application assembly coupled to the actuator and operable to apply mastic to the tape, the mastic application assembly including a ratchet mechanism coupled to the tape advancing assembly and to the actuator, the ratchet mechanism including a transfer member engageable with the drive roller, wherein movement of the actuator in a first linear direction moves the tape advancing assembly in the first linear direction to advance the tape toward the drive roller and actuates the ratchet mechanism to rotate the drive roller via the transfer member to force mastic from the body and onto the advancing tape.

10. The taper tool of claim 9, wherein the ratchet mechanism comprises a first link, a second link and a shaft, the first link being connected, at a first end, to the tape advancing assembly, and at a second end to the second link, the second link being connected to the shaft and the shaft being coupled to the drive roller.

11. The taper tool of claim 10, wherein the ratchet mechanism further comprises a ratchet lever and a ratchet wheel comprising teeth, wherein movement of the actuator in the first linear direction actuates the ratchet mechanism to rotate the ratchet lever, which engages at least one of the teeth of the ratchet wheel to cause the ratchet wheel to rotate with the ratchet lever, rotation of the ratchet wheel causes the shaft to rotate, thereby rotating the drive roller to force mastic out of the body, and wherein movement of the actuator in the second linear direction actuates the ratchet mechanism to rotate the ratchet lever in an opposite direction, the ratchet lever sliding over the teeth of the ratchet wheel and not rotating the ratchet wheel as the ratchet lever moves in the opposite direction.

12. The taper tool of claim 10, wherein the ratchet mechanism further comprises a first ratchet wheel and a second ratchet wheel supported on the shaft, the first and second ratchet wheels each having teeth defined in their adjacent surfaces, wherein movement of the actuator in the first linear direction actuates the ratchet mechanism to rotate the first ratchet wheel, the teeth of which engage the teeth of the second ratchet wheel to cause the second ratchet wheel to rotate with the first ratchet wheel, rotation of the second ratchet wheel causes the shaft to rotate, thereby rotating the drive roller to force mastic out of the body, and wherein movement of the actuator in the second linear direction actuates the ratchet mechanism to rotate the first ratchet wheel in an opposite direction, the teeth of the first ratchet wheel slide over the teeth of the second ratchet wheel and do not rotate the second ratchet wheel with the first ratchet wheel as the first ratchet wheel rotates in the opposite direction.

13. The taper tool of claim 9, wherein the actuator is a sleeve.

14. The taper tool of claim 9, wherein the mastic application assembly further comprises at least one link pivotal relative to the tape advancing assembly, the transfer member being coupled to the at least one link.

15. The taper tool of claim 14, wherein the mastic application assembly further comprises a first link and a second link, the first link being pivotally connected, at a first end, to the tape advancing assembly and being pivotally connected, at a second end, to a first end of the second link, the transfer member being connected to the second link.

16. The taper tool of claim 15, further comprising a pulley, and wherein the transfer member is rigidly connected to the second link and couples a shaft of the drive roller and the pulley.

17. The taper tool of claim 9, wherein movement of the actuator in a second linear direction moves the tape advancing assembly in the second linear direction, the tape not advancing or retracting and the mastic not being forced from the body during movement of the actuator in the second linear direction.

18. The taper tool of claim 17, wherein movement of the actuator in the second linear direction actuates the mastic application assembly to rotate the drive roller in a second rotational direction via the transfer member.

* * * * *

UNITED STATES PATENT AND TRADEMARK OFFICE

CERTIFICATE OF CORRECTION

PATENT NO. : 7,624,782 B2
APPLICATION NO. : 11/213049
DATED : December 1, 2009
INVENTOR(S) : Jungklaus et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1102 days.

Signed and Sealed this

Twenty-sixth Day of October, 2010

David J. Kappos

David J. Kappos
*Director of the United States Patent and Trademark Office*